US010326196B2

(12) United States Patent
Kim et al.

(10) Patent No.: US 10,326,196 B2
(45) Date of Patent: Jun. 18, 2019

(54) ANTENNA DEVICE

(71) Applicant: Samsung Electronics Co., Ltd., Suwon-si (KR)

(72) Inventors: Yoon-Geon Kim, Busan (KR); Won-Bin Hong, Seoul (KR); Seung-Tae Ko, Bucheon-si (KR)

(73) Assignee: Samsung Electronics Co., Ltd (KR)

( * ) Notice: Subject to any disclaimer, the term of this patent is extended or adjusted under 35 U.S.C. 154(b) by 393 days.

(21) Appl. No.: 14/866,423

(22) Filed: Sep. 25, 2015

(65) Prior Publication Data

US 2016/0093939 A1 Mar. 31, 2016

(30) Foreign Application Priority Data

Sep. 25, 2014 (KR) ..... 10-2014-0128716

(51) Int. Cl.
*H01Q 1/22* (2006.01)
*H01Q 1/50* (2006.01)
(Continued)

(52) U.S. Cl.
CPC ..... *H01Q 1/22* (2013.01); *H01Q 1/243* (2013.01); *H01Q 1/44* (2013.01); *H01Q 1/50* (2013.01);
(Continued)

(58) Field of Classification Search
CPC ..... H01Q 1/22; H01Q 1/243; H01Q 1/50; H01Q 15/006
(Continued)

(56) References Cited

U.S. PATENT DOCUMENTS 5,386,215 A * 1/1995 Brown ..... H01Q 1/38 343/792.5
5,689,275 A * 11/1997 Moore ..... H01Q 3/2676 343/772
(Continued)

FOREIGN PATENT DOCUMENTS

CN 102931199 2/2013
CN 103367881 10/2013
(Continued)

OTHER PUBLICATIONS

International Search Report corresponding to International Application No. PCT/KR2015/010230, dated Jan. 12, 2016.
(Continued)

*Primary Examiner* — Dameon E Levi
*Assistant Examiner* — Ab Salam Alkassim, Jr.
(74) *Attorney, Agent, or Firm* — The Farrell Law Firm, P.C.

(57) ABSTRACT

According to an embodiment of the present disclosure, an antenna device implemented in a display device may comprise a dielectric layer provided in the display device, an antenna area disposed in a surface of the dielectric layer provided in a transparent area of the display device and having at least one or more antenna patterns transmitting or receiving an electromagnetic wave through a plurality of conductive grids, a power feeding area provided in at least one of the transparent area and an opaque area of the display device and having a power feeding pattern providing a signal current to the antenna pattern through the plurality of conductive grids, and a transmission line portion connecting a substrate portion provided in the display device with the power feeding pattern. Further, the antenna device according to the present disclosure may also be implemented in other various embodiments.

14 Claims, 23 Drawing Sheets

(51) Int. Cl.
*H01Q 1/24* (2006.01)
*H01Q 1/44* (2006.01)
*H01Q 15/00* (2006.01)
*H01Q 21/06* (2006.01)

(52) U.S. Cl.
CPC ..... *H01Q 15/006* (2013.01); *H01Q 21/065* (2013.01)

(58) Field of Classification Search
USPC ..... 343/702, 700 MS
See application file for complete search history.

(56) References Cited

U.S. PATENT DOCUMENTS 6,064,350 A * 5/2000 Uchimura ..... H01P 3/121 343/700 MS
6,144,512 A * 11/2000 Eden ..... G02B 5/204 359/350
6,529,166 B2 * 3/2003 Kanamaluru ..... H01Q 25/00 343/700 MS
6,954,177 B2 * 10/2005 Channabasappa ..... H01Q 1/523 343/700 MS
7,136,029 B2 * 11/2006 Ramprasad ..... H01Q 1/22 343/909
7,209,083 B2 * 4/2007 Fujishima ..... H01Q 1/38 343/700 MS
7,362,285 B2 * 4/2008 Webb ..... H01Q 1/38 235/451
7,411,553 B2 * 8/2008 Oota ..... H01P 5/107 343/700 MS
7,522,105 B1 * 4/2009 LaComb ..... H01Q 1/28 343/700 MS
7,646,344 B2 * 1/2010 Liu ..... H01Q 9/0457 343/700 MS
7,932,578 B2 * 4/2011 Uchida ..... H01L 23/5227 257/531
8,462,490 B2 * 6/2013 Shin ..... B29C 45/14811 361/679.01
8,773,311 B2 * 7/2014 Ando ..... H01Q 15/0086 343/700 MS
8,890,750 B2 * 11/2014 Mak ..... H01Q 1/246 343/700 MS
8,890,761 B2 * 11/2014 Toyao ..... H01P 1/2005 343/700 MS
9,030,366 B2 * 5/2015 Ito ..... H01Q 1/52 343/787
9,209,513 B2 * 12/2015 Ely ..... C23C 14/16
9,343,804 B2 * 5/2016 Oh ..... H01Q 1/243
9,386,688 B2 * 7/2016 MacDonald ..... H01L 23/552
9,502,778 B2 * 11/2016 Shinkai ..... H01Q 1/38
9,570,814 B2 * 2/2017 Ando ..... H01Q 9/30
9,590,312 B1 * 3/2017 Buckley ..... H01Q 13/106
9,627,230 B2 * 4/2017 Carey ..... H01L 21/568
9,652,073 B2 * 5/2017 Lim ..... H01Q 1/36
9,923,277 B2 * 3/2018 Baek ..... H01Q 15/006
10,063,678 B2 * 8/2018 Wong ..... H04M 1/0277
2003/0201944 A1 * 10/2003 Aikawa ..... H01Q 13/10 343/770
2008/0179719 A1 * 7/2008 Nakashiba ..... H01L 23/522 257/664
2009/0051620 A1 * 2/2009 Ishibashi ..... H01Q 1/243 343/897
2010/0127943 A1 * 5/2010 Inoue ..... H01Q 15/14 343/702
2011/0210903 A1 * 9/2011 Sarabandi ..... H01Q 15/0086 343/904
2011/0298670 A1 * 12/2011 Jung ..... H01Q 1/243 343/702
2011/0300907 A1 * 12/2011 Hill ..... H01Q 9/285 455/566
2012/0157024 A1 * 6/2012 Tsukagoshi ..... H04B 5/0031 455/129
2012/0194392 A1 * 8/2012 Inoue ..... H01Q 9/0421 343/700 MS
2012/0293387 A1 * 11/2012 Ohno ..... H01Q 9/285 343/818
2013/0027268 A1 * 1/2013 Ohno ..... H01Q 9/285 343/818
2013/0120211 A1 * 5/2013 Zhang ..... H01Q 1/245 343/841
2013/0120221 A1 5/2013 Lindberg et al.
2013/0127672 A1 * 5/2013 Zhu ..... H01Q 1/2266 343/702
2014/0049437 A1 * 2/2014 Hung ..... H01Q 1/521 343/841
2014/0078006 A1 * 3/2014 Park ..... H01Q 1/38 343/700 MS
2014/0085151 A1 3/2014 Yang et al.
2014/0104157 A1 4/2014 Burns et al.
2014/0106684 A1 4/2014 Burns et al.
2014/0118962 A1 * 5/2014 Sabavat ..... H05K 1/0224 361/748
2014/0125533 A1 5/2014 Shi et al.
2014/0139379 A1 5/2014 Bolin et al.
2014/0313096 A1 * 10/2014 Baek ..... H01Q 15/006 343/841
2015/0029064 A1 * 1/2015 Pan ..... H01Q 1/22 343/720
2015/0255856 A1 * 9/2015 Hong ..... H01Q 1/243 343/702
2016/0093939 A1 3/2016 Kim et al.
2018/0269577 A1 * 9/2018 Kosaka ..... H01Q 3/44
2019/0020100 A1 * 1/2019 Jong ..... H01Q 1/52

FOREIGN PATENT DOCUMENTS

CN 205029005 2/2016
JP 2013-257755 12/2013
KR 10-2013-0070247 6/2013
KR 20130070247 A * 6/2013

OTHER PUBLICATIONS

Written Opinion of the International Searching Authority corresponding to International Application No. PCT/KR2015/010230, dated Jan. 12, 2016.
Chinese Office Action dated Jan. 2, 2019 issued in counterpart application No. 201510624092.5, 28 pages.

* cited by examiner

ANTENNA DEVICE

RELATED APPLICATION(S)

This application claims the benefit under 35 U.S.C. § 119(a) of a Korean patent application filed in the Korean Intellectual Property Office on Sep. 25, 2014 and assigned Serial No. 10-2014-0128716, the entire disclosure of which is incorporated herein by reference.

BACKGROUND

Embodiments of the present disclosure relate to antenna devices.

Wireless communication techniques are implemented in various ways, such as wireless local area network (WLAN) represented by Wi-Fi, Bluetooth, and near field communication (NFC), as well as by commercialized mobile communication network access technologies. Mobile communication services have evolved from the voice-centered first-generation mobile communication services to the fourth-generation mobile communication networks, enabling Internet and multimedia services. Commercial next-generation mobile communication services are expected to be offered through an ultra-high frequency bandwidth of a few tens of GHz.

Further, as communication standards such as WLAN or Bluetooth are widely used, electronic devices, e.g., mobile communication terminals, come with antenna devices that operate in various frequency bandwidths. For example, the fourth generation mobile communication service is operated in a frequency bandwidth of, e.g., 700 MHz, 1.8 GHz, or 2.1 GHz. Wi-Fi is operated in a frequency bandwidth of 2.4 GHz or 5 GHz, and Bluetooth is operated in a frequency bandwidth of 2.45 GHz, although slightly varied depending on their protocols.

Commercially available electronic devices, e.g., TVs and other large-sized electronics to small electronics such as portable terminals, have an increased screen size accomplished by reducing the bezel. Further, in order to provide constant service quality in a commercial wireless communication network while increasing the speed of radio communication and data transmission with diverse external devices, the antenna device of an electronic device needs to provide a high gain and wide beam coverage. The next-generation mobile communication service with a high-frequency bandwidth of a few tens of GHz may thus require higher performance than the antenna device used in the legacy commercial mobile communication services. For example, a higher frequency bandwidth of a radio signal may more quickly transmit a high volume of information. However, as the frequency bandwidth is increased, the straightness of the wireless signal is increased. Accordingly, the wireless signal may be reflected or blocked by an obstacle or its arrival distance may be shortened.

However, the recent trend for electronic devices is to transmit a higher volume of data more rapidly while still installing or positioning the antenna device into a limited size or shape. Further, as the bezel size of the electronic device is reduced and the screen size is increased, the installation space for the antenna device that is placed to radiate in the front direction is gradually reducing. However, a change in the installation position of the antenna device may render it difficult to secure an antenna radiation efficiency.

Further, the electronic device equipped with various antenna devices such as a mobile communication service, Wi-Fi, Bluetooth, and NFC, may have difficulty securing stabilized communication performance in an ultra-high frequency bandwidth.

Proposed are techniques of putting the antenna devices with an antenna radiation efficiency in a display device in a slim, reduced-bezel electronic device. The display device has a touchscreen panel; therefore, electromagnetic waves radiated from the touchscreen panel may interfere and negatively affect the antenna modules.

Further, the display panel or touchscreen panel in the display device may generate about 1 MHz drive pulses that may cause high frequency interference. That is, when two or more radio frequency (RF) devices come along, the devices may experience deteriorated performance due to securing isolation therebetween.

Further, in the case of an antenna device with a conductive grid shape, as the conductive grid has a high surface resistance, an excessive loss may occur in the power feeding portion. Resistance is proportional to the length per unit area (resistance=length/cross section area). Accordingly, as the conductive grid of the antenna device has a higher resistance, the efficiency of the antenna device is decreased.

The conductive grid may be provided in the antenna area of the antenna device. When the conductive grid includes a resistance component, the antenna modules may go through sharply reduced efficiency, radiation performance, or even an operation failure.

The above information is presented as background information only to assist with an understanding of the present disclosure. No determination has been made, and no assertion is made, as to whether any of the above might be applicable as prior art with regard to the present disclosure.

SUMMARY

Accordingly, an embodiment of the present disclosure provides an antenna device that is provided in a display panel and that may be flexibly relocated depending on the installation position of the touchscreen panel.

Further, according to an embodiment of the present disclosure, there is provided an antenna device that may diversify power feeding depending on the position where the antenna module is mounted.

Further, according to an embodiment of the present disclosure, there is provided an antenna device that may perform power feeding on the same plane (co-planar) or on different planes (differential-layer). Further, the antenna device may enable smooth power feeding to the antenna module and minimize a feeding loss.

Further, according to an embodiment of the present disclosure, there is provided an antenna device that may provide power feeding to the antenna module implemented on a display panel by various methods, thus allowing the antenna module to be mounted at various positions.

Further, according to an embodiment of the present disclosure, there is provided an antenna device that allows the conductive grids of the antenna module to have a lower resistance.

Further, according to an embodiment of the present disclosure, there is provided an antenna device for minimizing a loss over the transmission line of the antenna module.

Further, according to an embodiment of the present disclosure, there is provided an antenna device considering the resistance to increase the efficiency of the antenna module.

In accordance with an aspect of an embodiment of the present disclosure, an antenna device is implemented in a display device that may comprise a dielectric layer provided in the display device, an antenna area disposed in a surface of the dielectric layer, provided in a transparent area of the display device, and having at least one or more antenna patterns transmitting or receiving an electromagnetic wave through a plurality of conductive grids, a power feeding area provided in the transparent area or an opaque area of the display device and having a power feeding pattern providing a signal current to the antenna pattern through the plurality of conductive grids, and a transmission line portion connecting a substrate portion provided in the display device with the power feeding pattern.

According to an embodiment of the present disclosure, the antenna module may be flexibly located at various positions depending on the position where the touchscreen panel is mounted in the display device. Further, the power feeding portion may be located at various positions depending on the position where the antenna module is placed.

Further, according to an embodiment of the present disclosure, as the antenna module is implemented on the display panel of the display device, a space for mounting the antenna device may be secured.

Further, according to an embodiment of the present disclosure, a plurality of antennas may be mounted on the display panel depending on power feeding, so that the antennas may function as an array antenna. Further, antenna output may be increased, reducing the power consumption upon transmission or reception.

Further, according to an embodiment of the present disclosure, power feeding to the antenna module may be rendered possible depending on the position where the antenna module is mounted. Further, when power is fed to the antenna module implemented on the display panel, the power feeding may be performed in a type coupled with the antenna module (direct type feeding) or in a type separated from the antenna module (coupling type feeding). Further, when a plurality of antenna modules are arrayed on the display panel, power feeding to the antenna modules may be performed by loop type feeding or parallel type feeding. That is, power feeding to the antenna modules may be smoothly performed in whatever positions the antenna modules are located in the display device, minimizing feeding loss. Further, power feeding to the antenna module may be possible in various ways, allowing the antenna module to be located at various positions.

Further, according to an embodiment of the present disclosure, the antenna device may achieve a lower resistance through the shape or form of the conductive grids provided in the antenna module.

Further, according to an embodiment of the present disclosure, an artificial magnetic conductor (AMC) may be provided on a surface of the dielectric layer to isolate the antenna module from the touchscreen panel. Or, an area for index matching may be implemented through a band stop transmission line (TL). Or, an omni-directional antenna module may be provided. Accordingly, the specific absorption rate (SAR) of electromagnetic waves created upon installing the broadside antenna may be restricted, minimizing the loss over the transmission line of the antenna module.

Other aspects, advantages, and salient features of the disclosure will become apparent to those skilled in the art from the following detailed description, which, taken in conjunction with the annexed drawings, discloses exemplary embodiments of the disclosure.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

Throughout the drawings, like reference numerals will be understood to refer to like parts, components, and structures.

DETAILED DESCRIPTION

Figure 1:
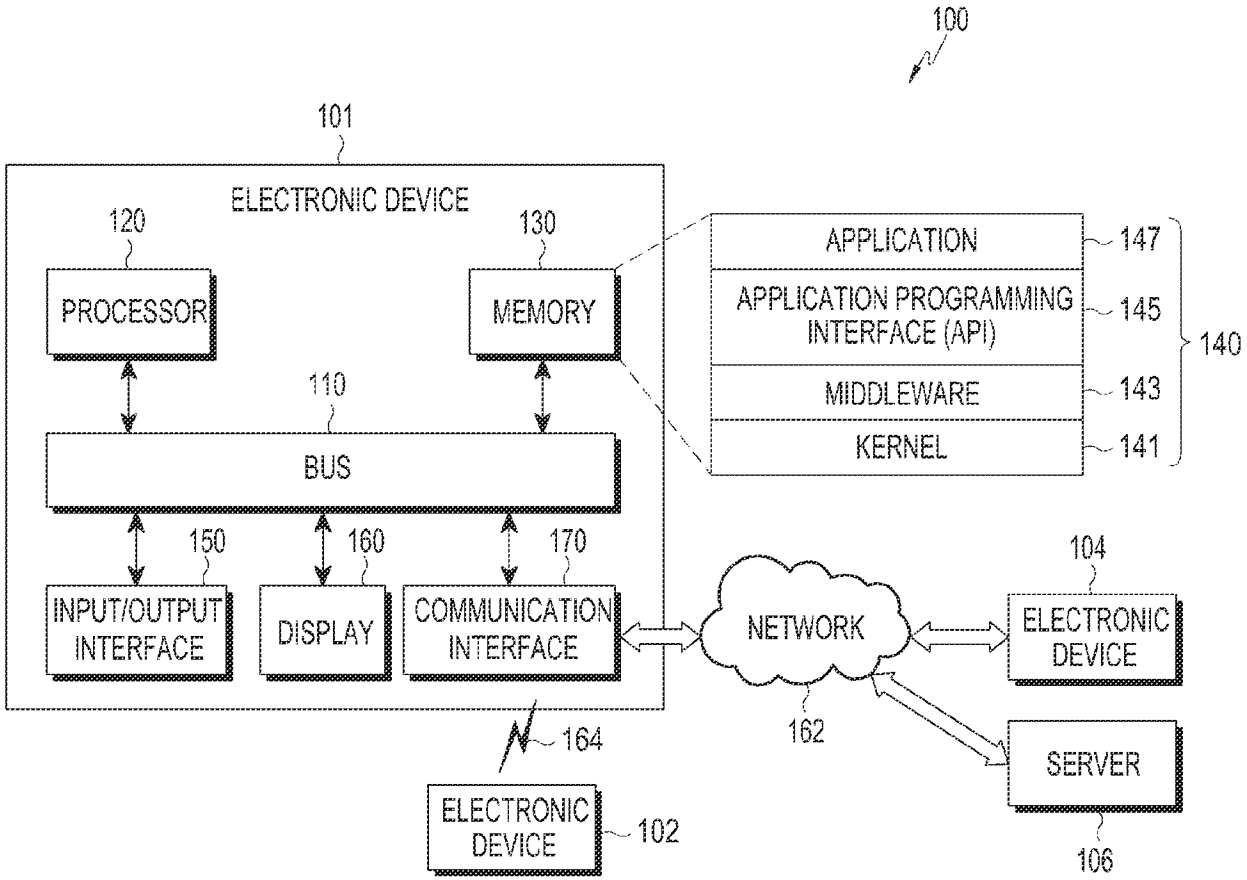
FIG. 1 is a view illustrating an electronic device 101 in a network environment 100 according to an embodiment of the present disclosure.

Hereinafter, embodiments of the present disclosure are described with reference to the accompanying drawings. However, it should be appreciated that the present disclosure is not limited to the embodiments, and all changes and/or equivalents or replacements thereto also belong to the scope of the present disclosure. The same or similar reference denotations may be used to refer to the same or similar elements throughout the specification and the drawings.

As used herein, the terms "have," "may have," "include," or "may include" a feature (e.g., a number, function, operation, or a component such as a part) indicate the existence of the feature and do not exclude the existence of other features.

As used herein, the terms "A or B," "at least one of A and/or B," or "one or more of A and/or B" may include all possible combinations of A and B. For example, "A or B," "at least one of A and B," "at least one of A or B" may indicate (1) including at least one A, (2) including at least one B, or (3) including at least one A and at least one B.

As used herein, the terms "first" and "second" may modify various components regardless of importance and do not limit the components. These terms are only used to distinguish one component from another. For example, a first user device and a second user device may indicate different user devices from each other regardless of the order or importance of the devices. For example, a first component may be denoted a second component, and vice versa without departing from the scope of the present disclosure.

It will be understood that when an element (e.g., a first element) is referred to as being (operatively or communicatively) "coupled with/to," or "connected with/to" another element (e.g., a second element), it can be coupled or connected with/to the other element directly or via a third element. In contrast, it will be understood that when an element (e.g., a first element) is referred to as being "directly coupled with/to" or "directly connected with/to" another element (e.g., a second element), no other element (e.g., a third element) intervenes between the element and the other element.

As used herein, the terms "configured (or set) to" may be interchangeably used with the terms "suitable for," "having the capacity to," "designed to," "adapted to," "made to," or "capable of" depending on circumstances. The term "configured (or set) to" does not essentially mean "specifically designed in hardware to." Rather, the term "configured to" may mean that a device can perform an operation together with another device or parts. For example, the term "processor configured (or set) to perform A, B, and C" may mean a generic-purpose processor (e.g., a CPU or application processor) that may perform the operations by executing one or more software programs stored in a memory device or a dedicated processor (e.g., an embedded processor) for performing the operations.

The terms as used herein are provided merely to describe some embodiments thereof, but not to limit the scope of other embodiments of the present disclosure. It is to be understood that the singular forms "a," "an," and "the" include plural references unless the context clearly dictates otherwise. All terms including technical and scientific terms used herein have the same meaning as commonly understood by one of ordinary skill in the art to which the embodiments of the present disclosure belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein. In some cases, the terms defined herein may be interpreted to exclude embodiments of the present disclosure.

For example, examples of the electronic device according to embodiments of the present disclosure may include at least one of a smartphone, a tablet personal computer (PC), a mobile phone, a video phone, an e-book reader, a desktop PC, a laptop computer, a netbook computer, a workstation, a PDA (personal digital assistant), a portable multimedia player (PMP), an MP3 player, a mobile medical device, a camera, or a wearable device (e.g., smart glasses, a head-mounted device (HMD), electronic clothes, an electronic bracelet, an electronic necklace, an electronic appcessory, an electronic tattoo, a smart minor, or a smart watch).

According to an embodiment of the present disclosure, the electronic device may be a smart home appliance. For example, examples of the smart home appliance may include at least one of a television, a digital video disk (DVD) player, an audio player, a refrigerator, an air conditioner, a cleaner, an oven, a microwave oven, a washer, a drier, an air cleaner, a set-top box, a home automation control panel, a security control panel, a TV box (e.g., Samsung HomeSync™, Apple TV™, or Google TV™), a gaming console (Xbox™, PlayStation™), an electronic dictionary, an electronic key, a camcorder, or an electronic picture frame.

According to an embodiment of the present disclosure, examples of the electronic device may include at least one of various medical devices (e.g., diverse portable medical measuring devices (a blood sugar measuring device, a heartbeat measuring device, or a body temperature measuring device), a magnetic resonance angiography (MRA)

device, a magnetic re sonance imaging (MRI) device, a computed tomography (CT) device, an imaging device, or an ultrasonic device), a navigation device, a global positioning system (GPS) receiver, an event data recorder (EDR), a flight data recorder (FDR), an automotive infotainment device, an sailing electronic device (e.g., a sailing navigation device or a gyro compass), avionics, security devices, vehicular head units, industrial or home robots, automatic teller's machines (ATMs), point of sales (POS) devices, or Internet of Things devices (e.g., a bulb, various sensors, an electric or gas meter, a sprinkler, a fire alarm, a thermostat, a street light, a toaster, fitness equipment, a hot water tank, a heater, or a boiler).

According to various embodiments of the disclosure, examples of the electronic device may be at least one of furniture, part of a building/structure, an electronic board, an electronic signature receiving device, a projector, or various measurement devices (e.g., devices for measuring water, electricity, gas, or electromagnetic waves). According to an embodiment of the present disclosure, the electronic device may be one or a combination of the above-listed devices. According to an embodiment of the present disclosure, the electronic device may be a flexible electronic device. The electronic device disclosed herein is not limited to the above-listed devices, and may include new electronic devices depending on the development of technology.

Hereinafter, electronic devices are described with reference to the accompanying drawings, according to various embodiments of the present disclosure. As used herein, the term "user" may denote a human or another device (e.g., an artificial intelligent electronic device) using the electronic device.

FIG. 1 is a view illustrating an electronic device 101 in a network environment 100 according to an embodiment of the present disclosure. The electronic device 101 may include a bus 110, a processor 120, a memory 130, an input/output interface 150, a display 160, and a communication interface 170. In some embodiments, the electronic device 101 may exclude at least one of the components or may add another component.

The bus 110 may include a circuit for connecting the components 110, 120, 130, 150, 160, and 170 with one another and transferring communications (e.g., control messages and/or data) between the components.

The processor 120 may include one or more of a central processing unit (CPU), an application processor (AP), or a communication processor (CP). The processor 120 may perform control on at least one of the other components of the electronic device 101, and/or perform an operation or data processing relating to communication.

The memory 130 may include a volatile and/or non-volatile memory. For example, the memory 130 may store commands or data related to at least one other component of the electronic device 101. According to an embodiment of the present disclosure, the memory 130 may store software and/or a program 140. The program 140 may include, e.g., a kernel 141, middleware 143, an application programming interface (API) 145, and/or an application program (or "application") 147. At least a portion of the kernel 141, middleware 143, or API 145 may be denoted as an operating system (OS).

For example, the kernel 141 may control or manage system resources (e.g., the bus 110, processor 120, or a memory 130) used to perform operations or functions implemented in other programs (e.g., the middleware 143, API 145, or application 147). The kernel 141 may provide an interface that allows the middleware 143, the API 145, or the application 147 to access the individual components of the electronic device 101 to control or manage system resources.

The middleware 143 may function as a relay to allow the API 145 or the application 147 to communicate data with the kernel 141. A plurality of applications 147 may be provided. The middleware 143 may control (e.g., scheduling or load balancing) work requests received from the application 147, e.g., by allocation of the priority of using the system resources of the electronic device 101 (e.g., the bus 110, the processor 120, or the memory 130) to at least one application of the plurality of applications 147.

The API 145 is an interface allowing the application 147 to control functions provided from the kernel 141 or the middleware 143. For example, the API 145 may include at least one interface or function (e.g., a command) for file control, window control, image processing or text control.

The input/output interface 150 may serve as an interface that may, e.g., transfer commands or data input from a user or other external devices to other component(s) of the electronic device 101. Further, the input/output interface 150 may output commands or data received from other component(s) of the electronic device 101 to the user or the other external device.

The display 160 may include, e.g., a liquid crystal display (LCD), a light emitting diode (LED) display, an organic light emitting diode (OLED) display, or a microelectromechanical systems (MEMS) display, or an electronic paper display. The display 160 may display, e.g., various contents (e.g., text, images, videos, icons, or symbols) to the user. The display 160 may include a touchscreen and may receive, e.g., a touch, gesture, proximity or hovering input using an electronic pen or a body portion of the user.

For example, the communication interface 170 may set up communication between the electronic device 101 and an external device (e.g., a first electronic device 102, a second electronic device 104, or a server 106). For example, the communication interface 170 may be connected with the network 162 through wireless or wired communication to communicate with the external electronic device (e.g., the second electronic device 104 or server 106).

The wireless communication may use at least one of, e.g., LTE, LTE-A, CDMA, WCDMA, UMTS, WiBro, or GSM, as a cellular communication protocol. The wired connection may include at least one of universal serial bus (USB), high definition multimedia interface (HDMI), recommended standard-232 (RS-232), or plain old telephone service (POTS). The network 162 may include at least one of a telecommunication network, e.g., a computer network (e.g., LAN or WAN), Internet, or a telephone network.

The first and second external electronic devices 102 and 104 each may be a device of the same or a different type from the electronic device 101. According to an embodiment of the present disclosure, the server 106 may include a group of one or more servers. According to an embodiment of the present disclosure, all or some of operations executed on the electronic device 101 may be executed on another or multiple other electronic devices (e.g., the electronic devices 102 and 104 or server 106). According to an embodiment of the present disclosure, when the electronic device 101 should perform some function or service automatically or through a request, the electronic device 101, instead of executing the function or service on its own, may request another device (e.g., electronic devices 102 and 104 or server 106) to perform at least some functions associated therewith. The other electronic device (e.g., electronic devices 102 and 104 or server 106) may execute the requested functions or additional functions and transfer a result of the execution to the electronic device 101. The electronic device 101 may provide a requested function or service by processing the received result as it is or additionally. To that end, a cloud computing, distributed computing, or client-server computing technique, for example, may be used.

Figure 2:
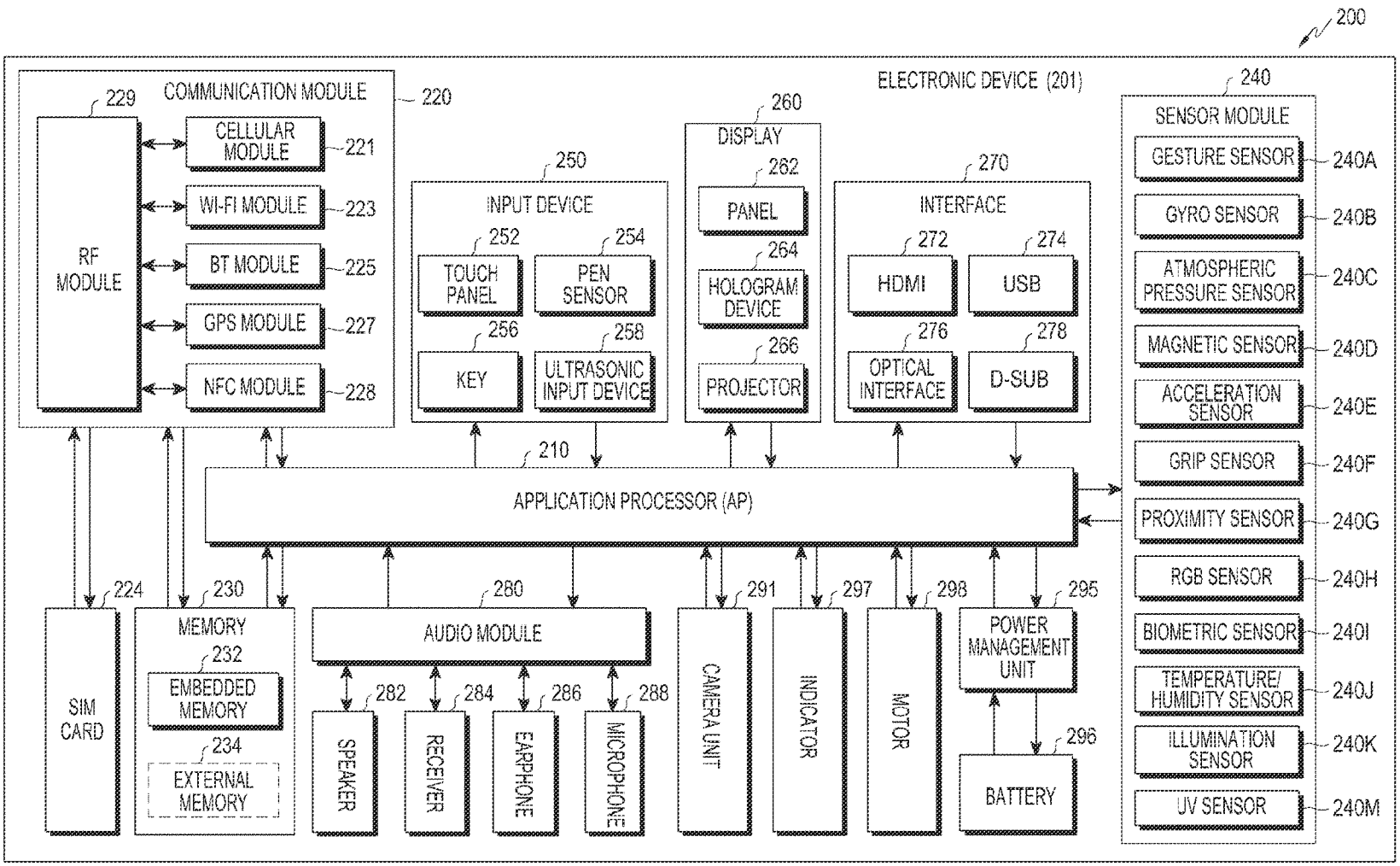
FIG. 2 is a block diagram 200 illustrating an electronic device 201 according to an embodiment of the present disclosure.

FIG. 2 is a block diagram 200 illustrating an electronic device 201 according to an embodiment of the present disclosure. The electronic device 201 may include the whole or part of the configuration of, e.g., the electronic device 101 shown in FIG. 1. The electronic device 201 may include one or more application processors (APs) 210, a communication module 220, a subscriber identification module (SIM) card 224, a memory 230, a sensor module 240, an input device 250, a display 260, an interface 270, an audio module 280, a camera module 291, a power management module 295, a battery 296, an indicator 297, and a motor 298.

The AP 210 may control multiple hardware and software components connected to the AP 210 by running, e.g., an operating system or application programs, and the AP 210 may process and compute various data. The AP 210 may be implemented in, e.g., a System on Chip (SoC). According to an embodiment of the present disclosure, the AP 210 may further include a graphic processing unit (GPU) and/or an image signal processor. The AP 210 may include at least some (e.g., the cellular module 221) of the components shown in FIG. 2. The AP 210 may load a command or data received from at least one of other components (e.g., a non-volatile memory) on a volatile memory, process the command or data, and store various data in the non-volatile memory.

The communication module 220 may have the same or similar configuration to the communication interface 170 of FIG. 1. The communication module 220 may include, e.g., a cellular module 221, a Wi-Fi module 223, a Bluetooth (BT) module 225, a global positioning system (GPS) module 227, a near field communication (NFC) module 228, and a radio frequency (RF) module 229.

The cellular module 221 may provide voice call, video call, text, or Internet services through, e.g., a communication network. According to an embodiment of the present disclosure, the cellular module 221 may perform identification or authentication on the electronic device 201 in the communication network using a subscriber identification module (e.g., the SIM card 224). According to an embodiment of the present disclosure, the cellular module 221 may perform at least some of the functions providable by the AP 210. According to an embodiment of the present disclosure, the cellular module 221 may include a communication processor (CP).

The Wi-Fi module 223, the BT module 225, the GPS module 227, or the NFC module 228 may include a process for, e.g., processing data communicated through the module. At least some (e.g., two or more) of the cellular module 221, the Wi-Fi module 223, the BT module 225, the GPS module 227, and the NFC module 228 may be included in a single integrated circuit (IC) or an IC package.

The RF module 229 may communicate by using, e.g., communication signals (e.g., RF signals). The RF module 229 may include, e.g., a transceiver, a power amp module (PAM), a frequency filter, a low noise amplifier (LNA), or an antenna. According to an embodiment of the present disclosure, at least one of the cellular module 221, the Wi-Fi module 223, the BT module 225, the GPS module 227, or the NFC module 228 may communicate RF signals through a separate RF module.

The SIM card 224 may include, e.g., a card including a subscriber identification module and/or an embedded SIM, and may contain unique identification information (e.g., an integrated circuit card identifier (ICCID)) or subscriber information (e.g., an international mobile subscriber identity (IMSI)).

The memory 230 (e.g., the memory 130) may include, e.g., an embedded memory 232 or an external memory 234. The embedded memory 232 may include at least one of, e.g., a volatile memory (e.g., a dynamic RAM (DRAM), a static RAM (SRAM), a synchronous dynamic RAM (SDRAM), etc.) or a non-volatile memory (e.g., a one time programmable ROM (OTPROM), a programmable ROM (PROM), an erasable and programmable ROM (EPROM), an electrically erasable and programmable ROM (EEPROM), a mask ROM, a flash ROM, a flash memory (e.g., a NAND flash, or a NOR flash), a hard drive, or solid state drive (SSD)).

The external memory 234 may include a flash drive, e.g., a compact flash (CF) memory, a secure digital (SD) memory, a micro-SD memory, a min-SD memory, an extreme digital (xD) memory, or a memory Stick™. The external memory 234 may be functionally and/or physically connected with the electronic device 201 via various interfaces.

The sensor module 240 may measure a physical quantity or detect an operational stage of the electronic device 201, and the sensor module 240 may convert the measured or detected information into an electrical signal. The sensor module 240 may include at least one of, e.g., a gesture sensor 240A, a gyro sensor 240B, an atmospheric pressure sensor 240C, a magnetic sensor 240D, an acceleration sensor 240E, a grip sensor 240F, a proximity sensor 240G, a color sensor 240H such as an RGB (Red, Green, Blue) sensor, a biometric sensor 240I, a temperature/humidity sensor 240J, an illumination sensor 240K, or an Ultra Violet (UV) sensor 240M. Additionally or alternatively, the sensor module 240 may include, e.g., an E-nose sensor, an electromyography (EMG) sensor, an electroencephalogram (EEG) sensor, an electrocardiogram (ECG) sensor, an infrared (IR) sensor, an iris sensor, or a finger print sensor. The sensor module 240 may further include a control circuit for controlling at least one or more of the sensors included in the sensor module 240. According to an embodiment of the present disclosure, the electronic device 201 may further include a processor configured to control the sensor module 240 as part of an AP 210 or separately from the AP 210, and the electronic device 201 may control the sensor module 240 while the AP is in a sleep mode.

The input device 250 may include a touch panel 252, a (digital) pen sensor 254, a key 256, or an ultrasonic input device 258. The touch panel 252 may use at least one of capacitive, resistive, infrared, or ultrasonic methods. The touch panel 252 may further include a control circuit. The touch panel 252 may further include a tactile layer and may provide a user with a tactile reaction.

The (digital) pen sensor 254 may include, e.g., a part of a touch panel or a separate sheet for recognition. The key 256 may include e.g., a physical button, optical key or key pad. The ultrasonic input device 258 may use an input tool that generates an ultrasonic signal and enables the electronic device 201 to detect data by sensing the ultrasonic signal to a microphone (e.g., the microphone 288).

The display 260 (e.g., the display 160) may include a panel 262, a hologram device 264, or a projector 266. The panel 262 may have the same or similar configuration to the display 160 of FIG. 1. The panel 262 may be implemented to be flexible, transparent, or wearable. The panel 262 may also be incorporated with the touch panel 252 in a unit. The hologram device 264 may make three dimensional (3D) images (holograms) in the air by using light interference. The projector 266 may display an image by projecting light onto a screen. The screen may be, for example, located inside or outside of the electronic device 201. In accordance with an embodiment, the display 260 may further include a control circuit to control the panel 262, the hologram device 264, or the projector 266.

The interface 270 may include e.g., a High Definition Multimedia Interface (HDMI) 272, a USB 274, an optical interface 276, or a D-subminiature (D-sub) 278. The interface 270 may be included in e.g., the communication interface 170 shown in FIG. 1. Additionally or alternatively, the interface 270 may include a Mobile High-definition Link (MHL) interface, a secure digital (SD) card/multimedia card (MMC) interface, or IrDA standard interface.

The audio module 280 may convert a sound into an electric signal or vice versa, for example. At least a part of the audio module 280 may be included in e.g., the input/output interface 150 as shown in FIG. 1. The audio module 280 may process sound information input or output through e.g., a speaker 282, a receiver 284, an earphone 286, or a microphone 288.

For example, the camera unit 291 may be a device for capturing still images and videos, and may include, according to an embodiment of the present disclosure, one or more image sensors (e.g., front and back sensors), a lens, an Image Signal Processor (ISP), or a flash such as an LED or xenon lamp.

The power management unit 295 may manage power of the electronic device 201. Although not shown, according to an embodiment of the present disclosure, a Power management Integrated Circuit (PMIC), a charger IC, or a battery or fuel gauge is included in the power management unit 295. The PMIC may have a wired and/or wireless recharging scheme. The wireless charging scheme may include e.g., a magnetic resonance scheme, a magnetic induction scheme, or an electromagnetic wave based scheme, and an additional circuit, such as a coil loop, a resonance circuit, a rectifier, or the like may be added for wireless charging. The battery gauge may measure an amount of remaining power of the battery 296, a voltage, a current, or a temperature while the battery 296 is being charged. The battery 296 may include, e.g., a rechargeable battery or a solar battery.

The indicator 297 may indicate a particular state of the electronic device 201 or a part of the electronic device (e.g., the AP 210), the particular state including e.g., a booting state, a message state, or charging state. The motor 298 may convert an electric signal to a mechanical vibration and may generate a vibrational or haptic effect. Although not shown, a processing unit for supporting mobile TV, such as a GPU may be included in the electronic device 201. The processing unit for supporting mobile TV may process media data conforming to a standard for Digital Multimedia Broadcasting (DMB), Digital Video Broadcasting (DVB), or media flow.

Each of the aforementioned components of the electronic device may include one or more parts, and a name of the part may vary with a type of the electronic device. The electronic device in accordance with various embodiments of the present disclosure may include at lest one of the aforementioned components, omit some of them, or include other additional component(s). Some of the components may be combined into an entity, but the entity may perform the same functions as the components may do.

Figure 3:
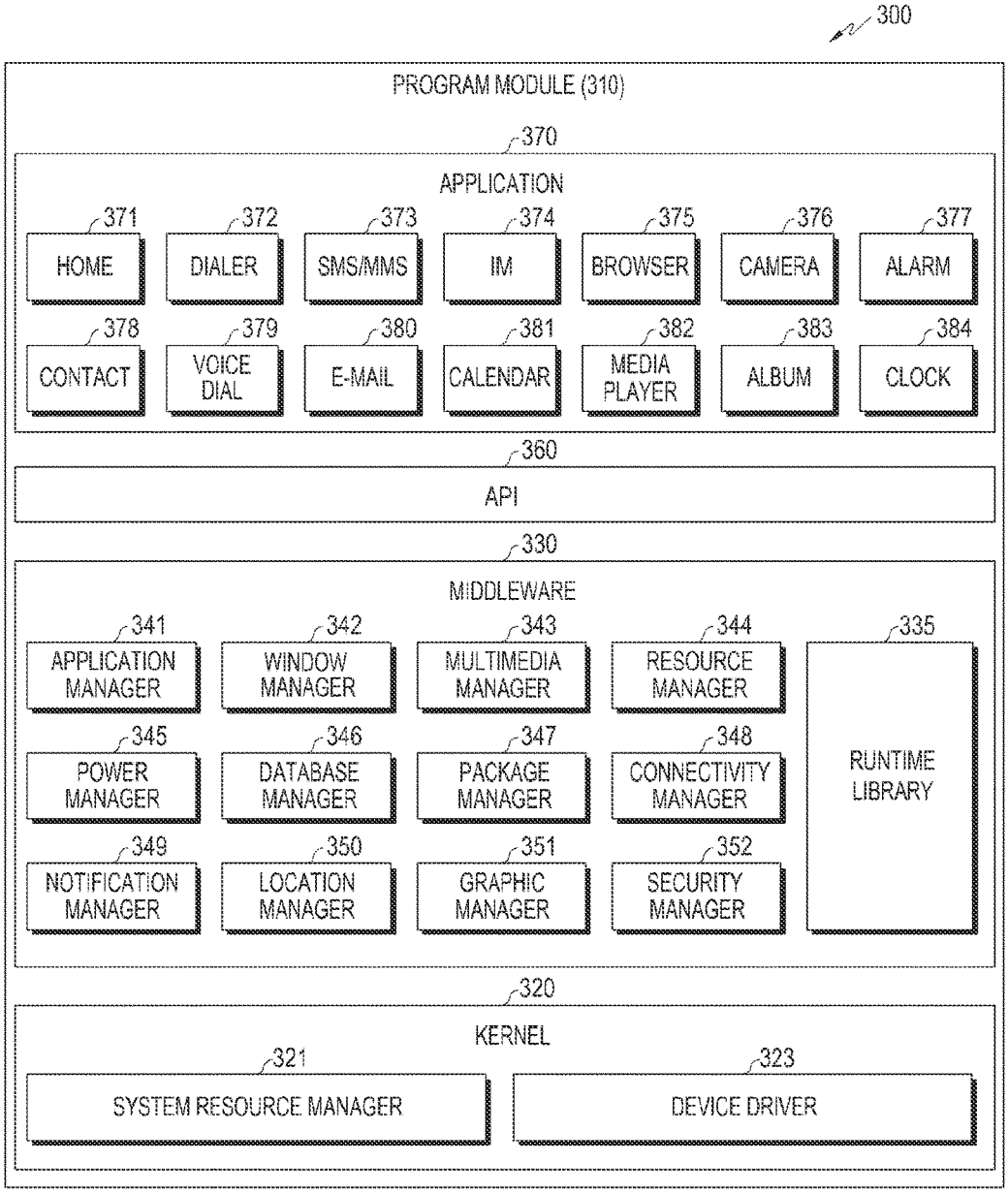
FIG. 3 is a block diagram 300 illustrating a program module 310 according to an embodiment of the present disclosure.

FIG. 3 is a block diagram 300 illustrating a program module 310 according to an embodiment of the present disclosure. According to an embodiment of the present disclosure, the program module 310 (e.g., the program 140) may include an operating system (OS) controlling resources related to the electronic device (e.g., the electronic device 101) and/or various applications (e.g., the application 147) driven on the operating system. The operating system may include, e.g., Android, iOS, Windows, Symbian, Tizen, or Bada.

The program module 310 may include, e.g., a kernel 320, middleware 330, an application programming interface (API) 360, and/or an application(s) 370. At least a part of the program module 310 may be preloaded on the electronic device or may be downloaded from a server (e.g., the server 106 of FIG. 1).

The kernel 320 (e.g., the kernel 141 of FIG. 1) may include, e.g., a system resource manager 321 or a device driver 323. The system resource manager 321 may perform control, allocation, or recovery of system resources. According to an embodiment of the present disclosure, the system resource manager 321 may include a process managing unit, a memory managing unit, or a file system managing unit. The device driver 323 may include, e.g., a display driver, a camera driver, a Bluetooth driver, a shared memory driver, a USB driver, a keypad driver, a WiFi driver, an audio driver, or an inter-process communication (IPC) driver.

The middleware 330 may provide various functions to the application 370 through the API 360 so that the application 370 may efficiently use the limited system resources in the electronic device or provide functions jointly required by applications 370. According to an embodiment of the present disclosure, the middleware 330 (e.g., middleware 143) may include at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, or a security manager 352.

The runtime library 335 may include a library module used by a compiler in order to add a new function through a programming language while, e.g., the application 370 is being executed. The runtime library 335 may perform input/output management, memory management, or operations like arithmetic functions.

The application manager 341 may manage the life cycle of at least one application of, e.g., the applications 370. The window manager 342 may manage GUI resources used on the screen. The multimedia manager 343 may grasp formats necessary to play various media files and use a codec appropriate for a format to perform encoding or decoding on media files. The resource manager 344 may manage resources, such as source code of at least one of the applications 370, memory or storage space.

The power manager 345 may operate together with, e.g., a basic input/output system (BIOS) to manage battery or power and provide power information necessary for operating the electronic device. The database manager 346 may generate, search, or vary a database to be used in at least one of the applications 370. The package manager 347 may manage installation or update of an application that is distributed in the form of a package file.

The connectivity manager 348 may manage wireless connectivity, such as, e.g., WiFi or Bluetooth. The notification manager 349 may display or notify an event, such as a coming message, appointment, or proximity notification, of the user without interfering with the user. The location manager 350 may manage locational information on the electronic device. The graphic manager 351 may manage graphic effects to be offered to the user and their related user interface. The security manager 352 may provide various security functions necessary for system security or user authentication. According to an embodiment of the present disclosure, when the electronic device (e.g., the electronic device 101) has telephony capability, the middleware 330 may further include a telephony manager for managing voice call or video call functions of the electronic device.

The middleware 330 may include a middleware module forming a combination of various functions of the above-described components. The middleware 330 may provided a specified module per type of the operating system in order to provide a differentiated function. Further, the middleware 330 may dynamically omit some existing components or add new components.

The API 360 (e.g., the API 145) may be a set of, e.g., API programming functions and may have different configurations depending on operating systems. For example, in the case of Android or iOS, one API set may be provided per flatform, and in the case of Tizen, two or more API sets may be offered per flatform.

The application 370 (e.g., the application 147) may include one or more applications that may provide functions such as, e.g., a home 371, a dialer 372, an SMS/MMS 373, an instant message (IM) 374, a browser 375, a camera 376, an alarm 377, a contact 378, a voice dial 379, an email 380, a calendar 381, a media player 382, an album 383, or a clock 384, a health-care (e.g., measuring the degree of a workout or blood sugar) function, or a provision of environmental information (e.g., a provision of air pressure, moisture, or temperature information).

According to an embodiment of the present disclosure, the application 370 may include an application (hereinafter, "information exchanging application" for convenience) supporting information exchange between the electronic device (e.g., the electronic device 101) and an external electronic device (e.g., the electronic devices 102 and 104). Examples of the information exchange application may include, but is not limited to, a notification relay application for transferring specific information to the external electronic device, or a device management application for managing the external electronic device.

For example, the notification relay application may include a function for relaying notification information generated from other applications of the electronic device (e.g., the SMS/MMS application, email application, health-care application, or environmental information application) to the external electronic device (e.g., the electronic devices 102 and 104). Further, the notification relay application may receive notification information from, e.g., the external electronic device and may provide the received notification information to the user. The device management application may perform at least some functions of the external electronic device (e.g., the electronic device 104) e.g., communicating with the electronic device (for example, turning on/off the external electronic device or some components of the external electronic device) or control the brightness (or resolution) of the display, and the device management application may manage (e.g., install, delete, or update) an application operating in the external electronic device or a service (e.g., call service or message service) provided from the external electronic device.

According to an embodiment of the present disclosure, the application 370 may include an application (e.g., a health-care application) designed depending on the attribute (e.g., as an attribute of the electronic device such as the type of electronic device being a mobile medical device) of the external electronic device (e.g., the electronic devices 102 and 104). According to an embodiment of the present disclosure, the application 370 may include an application received from the external electronic device (e.g., the server 106 or electronic devices 102 and 104). According to an embodiment of the present disclosure, the application 370 may include a preloaded application or a third party application downloadable from a server. The names of the components of the program module 310 according to the shown embodiment may be varied depending on the type of operating system.

According to an embodiment of the present disclosure, at least a part of the program module 310 may be implemented in software, firmware, hardware, or in a combination of two or more thereof. At least a part of the program module 310 may be implemented (e.g., executed) by e.g., a processor (e.g., the AP 210). At least a part of the programming module 310 may include e.g., a module, program, routine, set of instructions, process, or the like for performing one or more functions.

The term 'module' may refer to a unit including one of hardware, software, and firmware, or a combination thereof. The term 'module' may be interchangeably used with a unit, logic, logical block, component, or circuit. The module may be a minimum unit or part of an integrated component. The 'module' may be a minimum unit or part of performing one or more functions. The module may be implemented mechanically or electronically. For example, the module may include at least one of Application Specific Integrated Circuit (ASIC) chips, Field Programmable Gate Arrays (FPGAs), or Programmable Logic Arrays (PLAs) that perform some operations, which have already been known or will be developed in the future.

According to an embodiment of the present disclosure, at least a part of the device (e.g., modules or their functions) or method (e.g., operations) may be implemented as instructions stored in a computer-readable storage medium e.g., in the form of a program module. The instructions, when executed by a processor (e.g., the processor 120 of FIG. 1), may enable the processor to carry out a corresponding function. The computer-readable storage medium may be, e.g., the memory 130.

The computer-readable storage medium may include a hardware device, such as hard discs, floppy discs, and magnetic tapes (e.g., a magnetic tape), optical media such as Compact Disc ROMs (CD-ROMs) and Digital Versatile Discs (DVDs), magneto-optical media such as floptical disks, ROMs, RAMs, Flash Memories, and/or the like. Examples of the program instructions may include not only machine language codes but also high-level language codes which are executable by various computing means using an interpreter. The aforementioned hardware devices may be configured to operate as one or more software modules to carry out exemplary embodiments of the present disclosure, and vice versa.

Modules or programming modules in accordance with various embodiments of the present disclosure may include at least one or more of the aforementioned components, omit some of them, or further include other additional components. Operations performed by modules, programming modules or other components in accordance with various embodiments of the present disclosure may be carried out sequentially, simultaneously, repeatedly, or heuristically. Furthermore, some of the operations may be performed in a different order, or omitted, or include other additional operation(s).

The embodiments disclosed herein are proposed for description and understanding of the disclosed technology and does not limit the scope of the present disclosure. Accordingly, the scope of the present disclosure should be interpreted as including all changes or various embodiments based on the technical spirit of the present disclosure.

Hereinafter, antenna devices are described in more detail with reference to FIGS. 4 to 19C in connection with various embodiments of the present disclosure.

Figure 4:
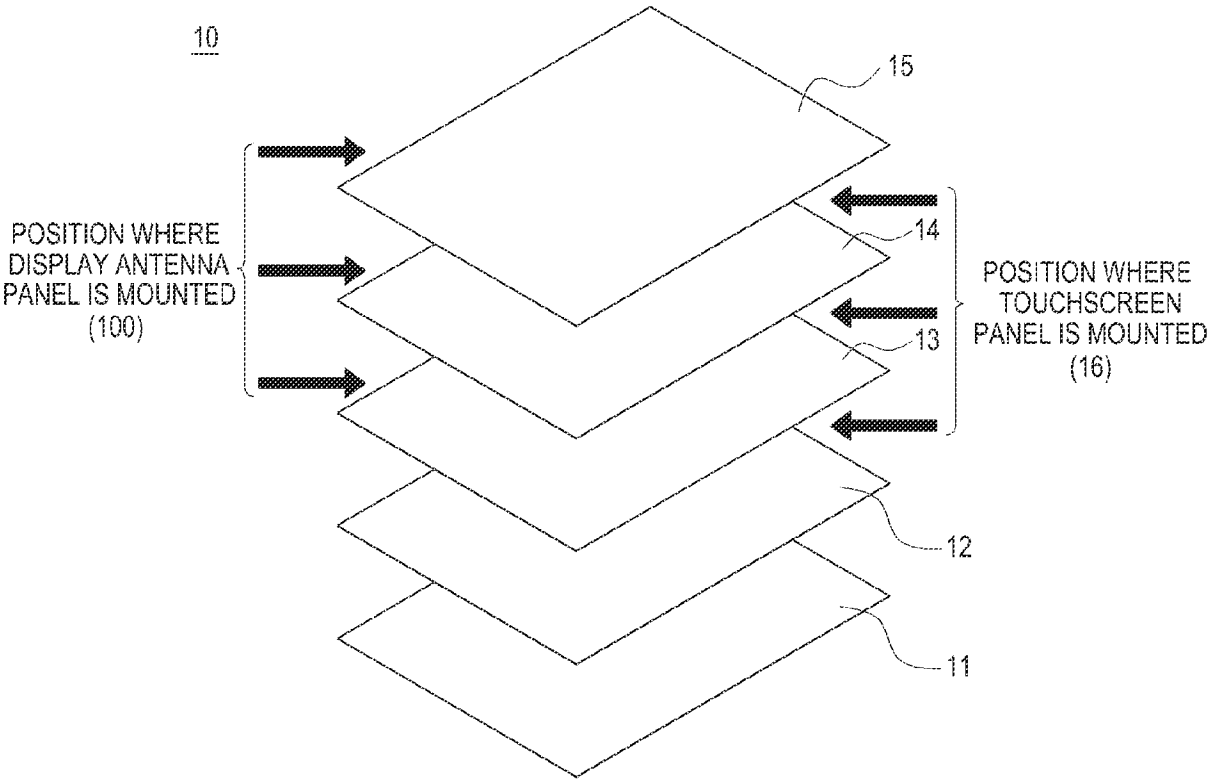
FIG. 4 is a cross-sectional view schematically illustrating a display device 10 having an antenna device 100 according to an embodiment of the present disclosure.
Figure 5:
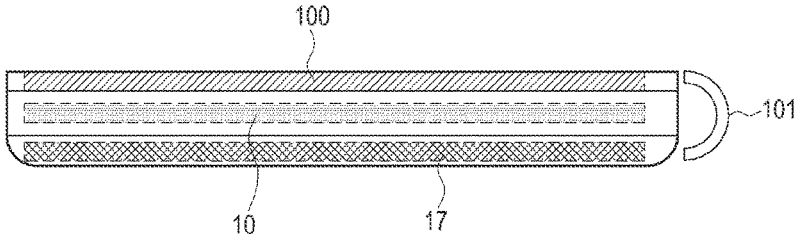
FIG. 5 is a cross-sectional view schematically illustrating a display device having an antenna device according to an embodiment of the present disclosure.
Figure 6A:
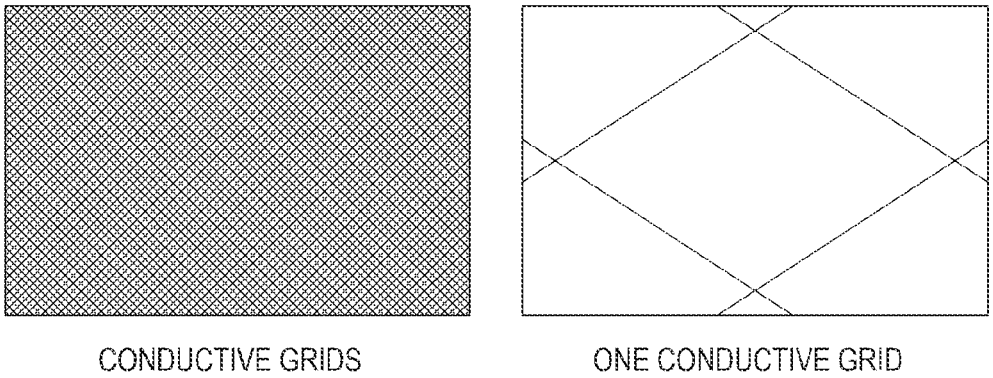
FIG. 6A, FIG. 6B, FIG. 6C, FIG. 6D are views illustrating conductive grids formed in a power feeding pattern and a process for deriving a resistance according to an embodiment of the present disclosure.
Figure 6B:
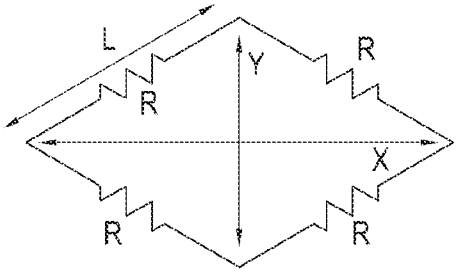
Figure 6C:
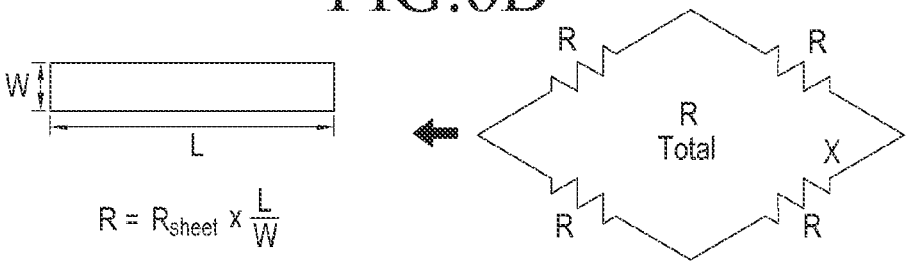
Figure 6D:
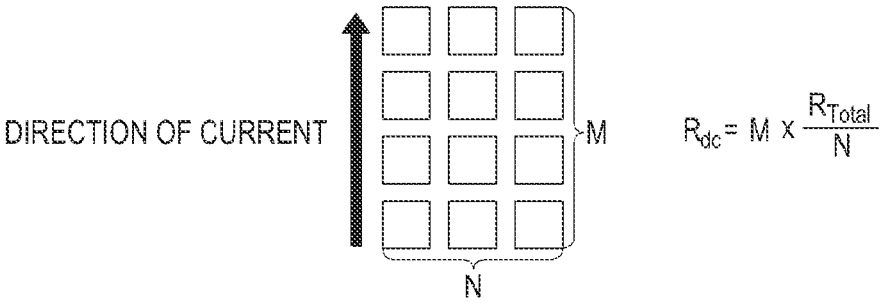

FIG. 4 is a cross-sectional view schematically illustrating a display device 10 having an antenna device 100 according to an embodiment of the present disclosure. FIG. 5 is a cross-sectional view schematically illustrating a display device having an antenna device according to an embodiment of the present disclosure.

Referring to FIGS. 4 and 5, according to an embodiment of the present disclosure, the display device 10 is configured to display a screen and to implement an input and includes a plurality of modules, e.g., a backlight unit 11, a window panel, and a touchscreen panel 16. The display device 10 may include one of various forms or materials, such as a Liquid Crystal Display (LCD) panel, a Light Emitting Diode (LED) panel, an Organic Light Emitting Diode (OLED) panel, or an Active Matrix Light Emitting Diode (AMOLED) panel, depending on methods for implementing images. An embodiment of the present disclosure in which the display device 10 has an LED or LCD panel stacking structure is described as an example. However, the display device 10 may be formed of one of the above-exemplified various panels.

According to an embodiment of the present disclosure, the stacking structure of panels provided in the display device 10 is described. The stacking structure includes, at its lower side, a backlight unit 11, a first polarizing plate formed of, e.g., polyimide, a TFT array panel 12, a rear glass panel 13, a second polarizing plate 14, and a cover glass panel 15 at its upper side. A touchscreen panel 16 sensing a contact or proximity may be disposed between the cover glass panel 15 and the second polarizing plate 14, between the second polarizing plate 14 and the rear glass panel 13, and/or between the rear glass panel 13 and the TFT array panel 12 depending on the installation environment or the stacks of the display device 10.

The touchscreen panel 16 may be implemented as a conductive film member, such as an Indium Tin Oxide (ITO) panel having a mesh grid including transparent conductive lines and electrodes.

Further, according to the present disclosure, the antenna device 100 (hereinafter, referred to as a 'display antenna panel 100') may be disposed adjacent to the touchscreen panel 16 on the cover glass panel 15, between the cover glass panel 15 and the second polarizing plate 14, and/or between the second polarizing plate 14 and the rear glass panel 13. Further, a circuit board unit 17 (in FIG. 5) may be provided under the display device 10 to supply power to the panels. Further, the display antenna panel 100 may be connected with an RF module 17*a* (see FIG. 16C and FIG. 19C) 17A of the circuit board unit 17 through a feeding portion 101, such as a cable or Flexible Printed Circuit Board (FPCB), to feed power from the circuit board unit 17 having a communication module to the display antenna panel 100.

The display device 10 may include a transparent area VA requiring a transmittance to display a screen and an opaque area BA that is positioned around the transparent area VA and that requires no transmittance. The transparent area VA should prevent the mesh grids of the touchscreen panel 16 or conductive grids (which are described below) of the display antenna panel 100 from being viewed such that a screen may be displayed through a view area. Further, the signal lines or the feeding portion 101 may be positioned under the opaque area BA and a printed layer (not shown) may be provided at the opaque area BA to shield the signal lines or the feeding portion 101.

According to the present disclosure, the display antenna panel 100 may implement an antenna pattern 121 and a power feeding pattern 131 with the transparent area VA and/or the opaque area BA (see FIG. 13A, FIG. 14A, FIG. 16A and FIG. 16B).

Specifically, according to an embodiment of the present disclosure, the display antenna panel 100 may include a dielectric layer 110, an antenna area 120, a power feeding area 130, and a feeding portion 101 (see FIG. 13A, FIG. 14A, FIG. 16A and FIG. 16B).

The dielectric layer 110 is stacked adjacent to the touchscreen panel 16 and may be disposed adjacent to the touchscreen panel 16 on the cover glass panel 15, between the cover glass panel 15 and the second polarizing plate 14, and/or between the second polarizing plate 14 and the rear glass panel 13 (see FIG. 13A, FIG. 14A, FIG. 16A and FIG. 16B).

The dielectric layer 110 may include the antenna area 120 having the antenna pattern 121 implemented with a plurality of conductive grids and the power feeding area 130 having the power feeding pattern 131 implemented with a plurality of conductive grids (see FIG. 13A, FIG. 14A, FIG. 16A and FIG. 16B).

Figure 7A:
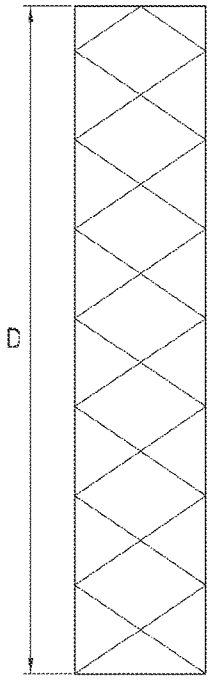
FIG. 7A and FIG. 7B are views illustrating conductive grids having different widths in an X direction or Y direction according to an embodiment of the present disclosure.
Figure 7B:
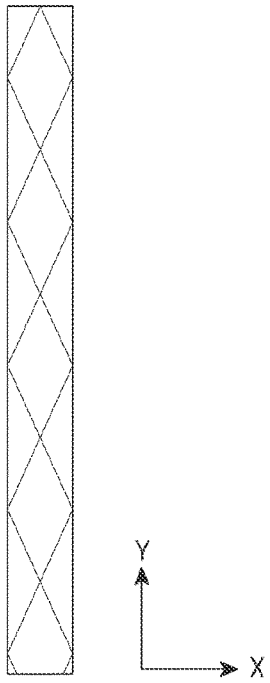
Figure 8:
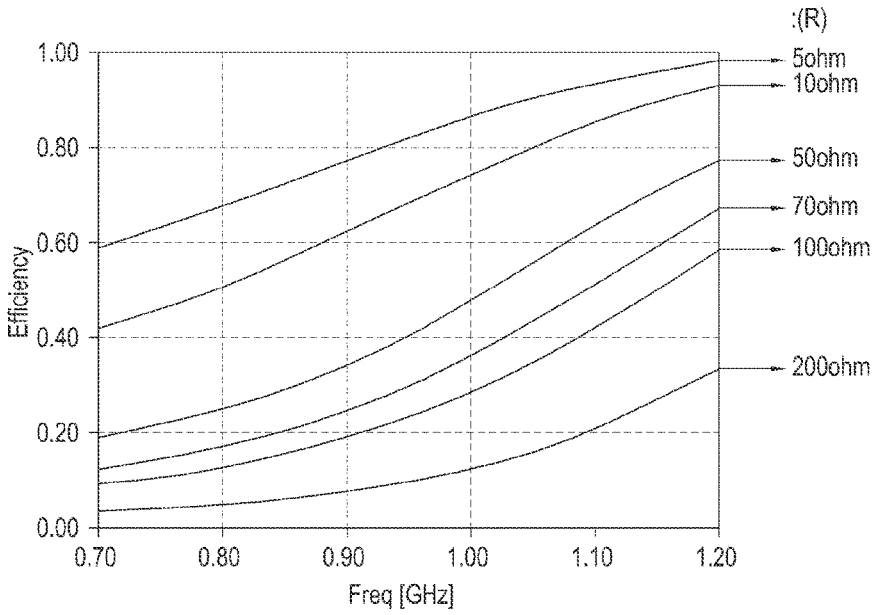
FIG. 8 is a graph illustrating antenna radiation performance depending on resistances according to an embodiment of the present disclosure.

FIG. 6A through FIG. 6D are a view illustrating conductive grids formed in a power feeding pattern and a process for deriving a resistance according to an embodiment of the present disclosure. FIG. 7A and FIG. 7B are a view illustrating conductive grids having different widths in an X direction or Y direction according to an embodiment of the present disclosure. FIG. 8 is a graph illustrating antenna radiation performance depending on resistances according to an embodiment of the present disclosure.

Referring to FIGS. 6 to 8, the plurality of conductive grids provided in the power feeding area and/or the plurality of conductive grids provided in the antenna area may be configured so that relatively more conductive grids may be provided in a parallel direction with respect to a direction along which a signal current is applied. The configuration also allows for relatively fewer conductive grids to be provided in a series direction with respect to the direction along which the signal current is applied. In particular, the plurality of conductive grids provided in the power feeding area may prevent a signal current applied through the feeding portion from being reduced in the power feeding area as the resistance in the direction of the signal current is decreased.

Specifically, the power feeding pattern formed of conductive grids on the dielectric layer 110 may reduce a resistance loss through the conductive grids, minimizing a transfer loss of signals flowing in through the feeding portion 101 (FIG. 5). That is, one conductive grid formed in the power feeding pattern may be sized such that a plurality of diamond-shaped conductive grids may be arranged in the power feeding pattern. In case the conductive grids have the same length 'L' with respect to the flow of current in a Y direction, if the X-directional width of the conductive grids is increased, relatively more conductive grids may be provided in a length 'D' as compared with when the 'Y' directional width of the conductive grids is increased. Accordingly, when relatively more conductive grids may be arranged in parallel and in a direction of the signal current, while relatively fewer conductive grids are provided in series, the resistance by the plurality of conductive grids provided in the same length may be decreased. Accordingly, the signal current flowing into the plurality of conductive grids having the same length may be prevented from decreasing. The "more conductive grids are provided in the same length 'D'" may mean that the resistance in the same length increases. When the resistance increases, the loss of signal current may be increased. Accordingly, when the conductive grids have the same length L and the current flows in the Y direction, the Y-directional width of the conductive grids may be formed to be relatively longer than the X-directional width thereof. Accordingly, when the number of conductive grids in the same length is minimized, the resistance may be lowered, and the signal current flowing in through a transmission line may be prevented from loss in the power feeding pattern.

Although relatively more conductive grids are arranged in the power feeding area in a parallel direction, while relatively fewer conductive grids are arranged in a series direction according to an embodiment of the present disclosure. However, this feature is not limited only to the conductive grids formed in the power feeding area. For example, the structure or configuration of the power feeding area or antenna area or the plurality of conductive grids in the power feeding area or antenna area may be implemented as described above.

Now described is a configuration for securing antenna radiation efficiency of the display antenna panel 100 partitioned into a transparent area VA and an opaque area BA with reference to FIGS. 9A to 11.

Figure 9A:
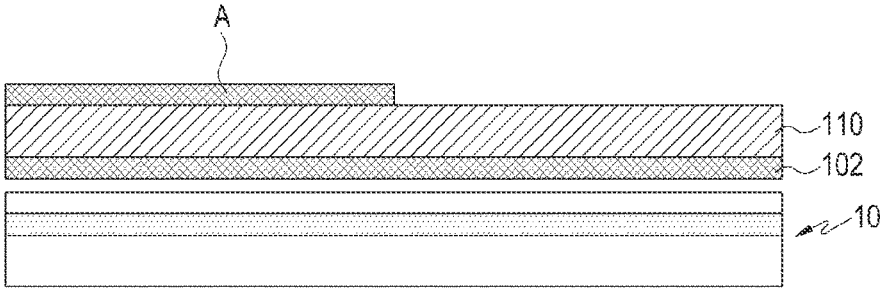
FIGS. 9A and 9B are views illustrating an antenna device having an artificial magnetic conductor according to an embodiment of the present disclosure.
Figure 9B:
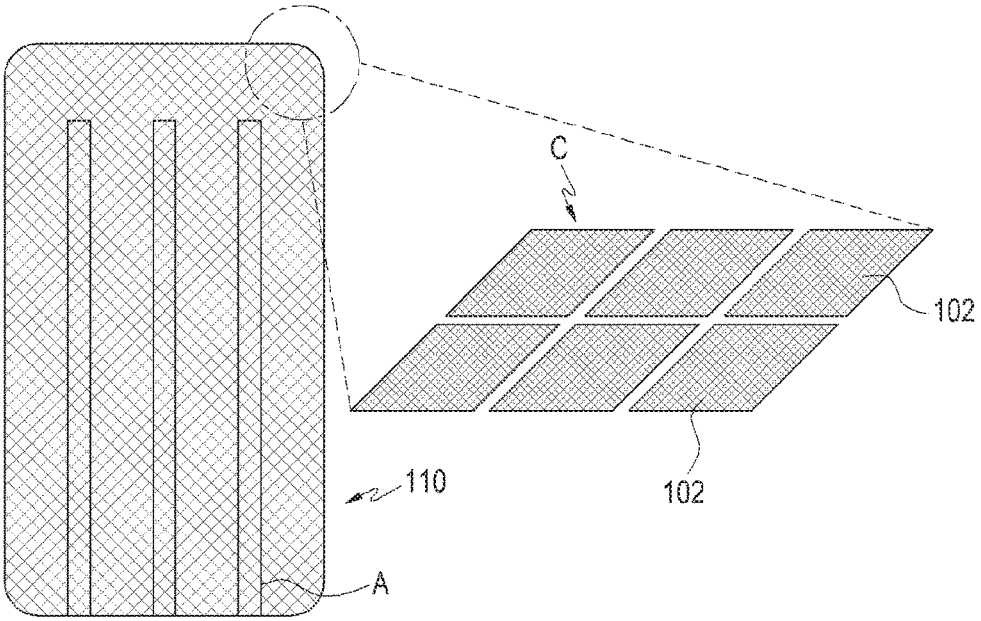

FIGS. 9A and 9B are views illustrating an antenna device having an artificial magnetic conductor according to an embodiment of the present disclosure.

Referring to FIGS. 9A and 9B, the display antenna panel 100 according to an embodiment of the present disclosure may include an artificial magnetic conductor (AMC) having a plurality of uniform cells C.

On a surface of the dielectric layer 110 there may be implemented an antenna pattern 121 or a power feeding pattern 131 or there may be mounted a wire-type antenna A. When the wire-type antenna A is mounted in the display antenna panel 100, a radiation efficiency may be interfered by various metals provided in the display device 10 (see FIG. 13A, FIG. 13B, FIG. 14A, FIG. 16A and FIG. 16B). However, the AMC 102 provided on the other surface of the dielectric layer 110 may provide isolation while preventing interference with the touchscreen panel 16 (FIG. 4) and the antenna A provided in the dielectric layer 110. Further, when the AMC 102 is formed of a plurality of uniform cells C, i.e., in a periodic structure, and thus, the wire-type antenna A is implemented in the transparent area VA, index matching may be secured to deteriorate visibility. That is, when the wire-type antenna A is mounted in the display antenna panel 100, the wire-type antenna A might not be mounted due to an influence from the touchscreen panel 16 (FIG. 4). However, as the AMC 102 is provided, a separate wire-type antenna A may be mounted on a surface of the dielectric layer 110.

Figure 10:
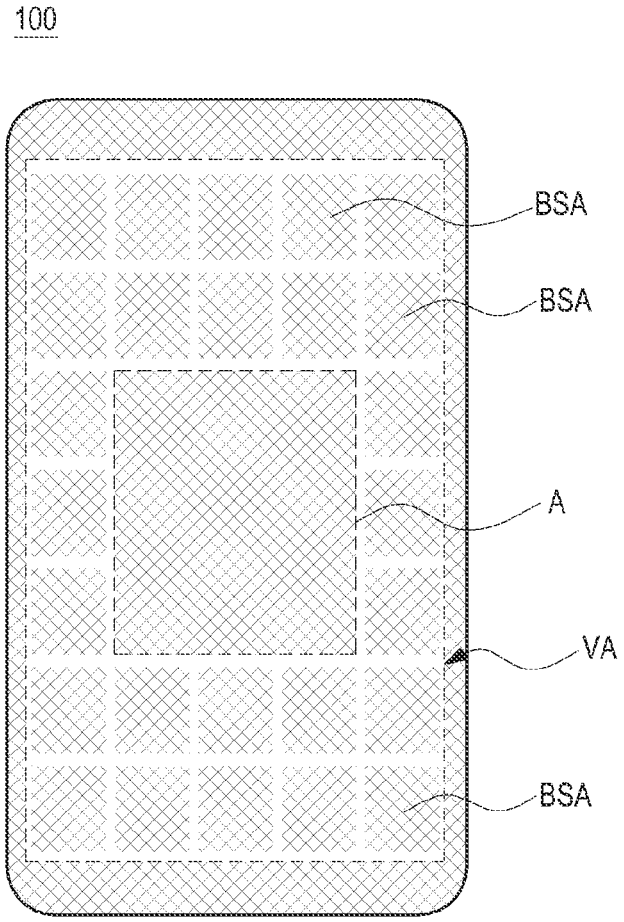
FIG. 10 is a view illustrating an antenna device having a stop band according to an embodiment of the present disclosure.

FIG. 10 is a view illustrating an antenna device having a stop band according to an embodiment of the present disclosure.

Referring to FIG. 10, an antenna A to be described below may be provided in the transparent area VA, and a band stop area (BSA) may be formed around the antenna A. The BSA may be formed in an inner side of the cells where a plurality of conductive grids are uniformly formed. The BSA may minimize the surface wave derived from the antenna A and may secure index matching in the transparent area VA other than the antenna A, thus deteriorating visibility.

Figure 11:
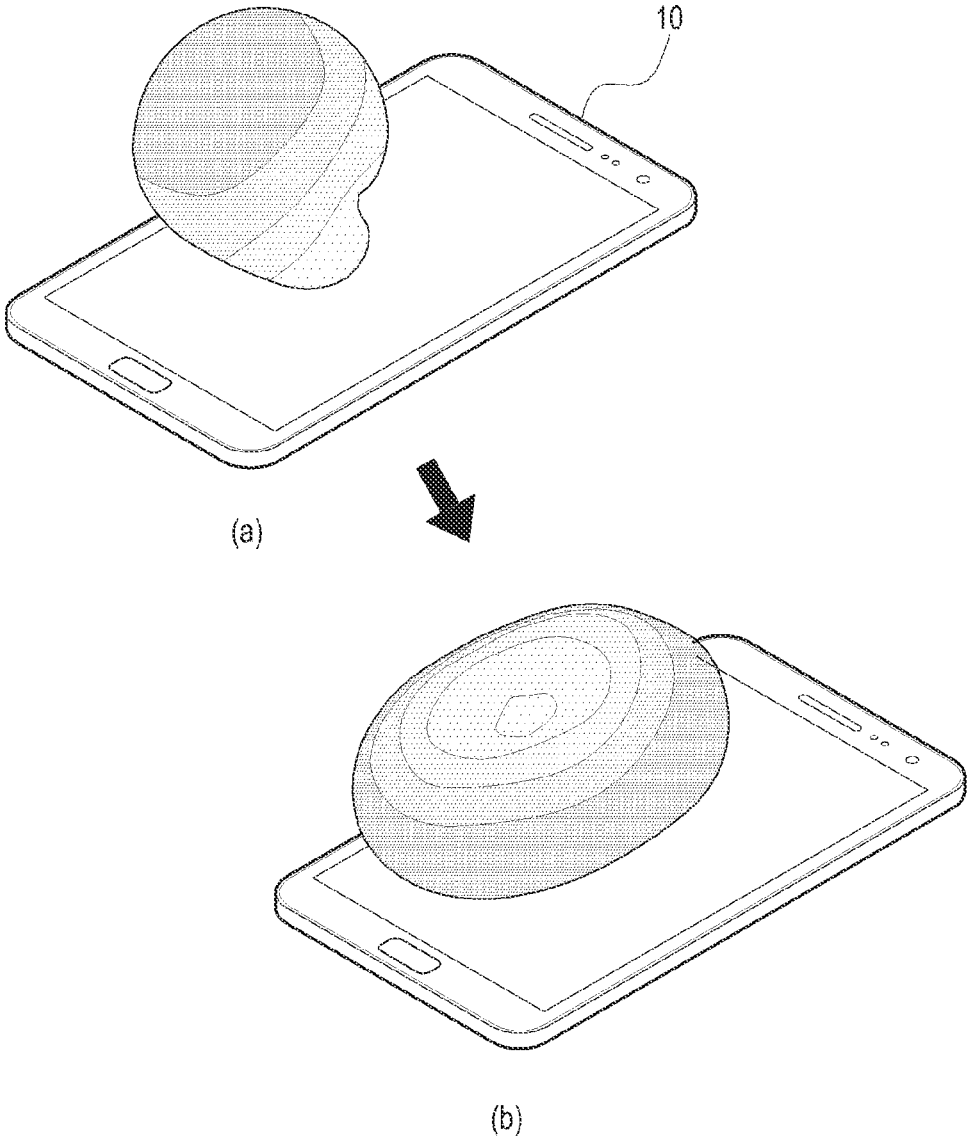
FIG. 11 is a view illustrating a radiation pattern of an antenna device for reducing an electromagnetic wave human absorption rate according to an embodiment of the present disclosure.

FIG. 11 is a view illustrating a radiation pattern of an antenna device for reducing an electromagnetic wave human absorption rate according to an embodiment of the present disclosure.

Referring to FIG. 11(*a*), when a broadside antenna is used in the electronic device having the display device 10, a vertical radiation pattern may be formed, increasing a specific absorption rate (SAR). Accordingly, Referring to FIG. 11(*b*) when the antenna pattern 121 formed in the display antenna panel 100 is designed to be planar and omni-directional, the formation of a vertical radiation pattern may be restricted (See FIG. 13A, FIG. 13B, FIG. 14A, FIG. 14B, FIG. 15A, FIG. 15B, FIG. 16A and FIG. 16B. Thus, the SAR may be reduced while minimizing a variation in antenna capability due to proximity or contact to the display device 10, data transmission or reception or a call.

FIGS. 12A to 12F are views illustrating various shapes of an antenna area and a power feeding area formed in a dielectric layer of an antenna device according to an embodiment of the present disclosure.

Figure 12A:
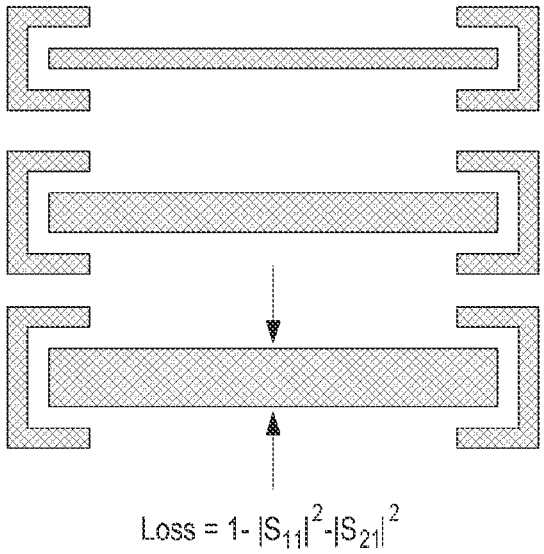
FIGS. 12A through 12F are views illustrating various shapes of an antenna area and a power feeding area formed in a dielectric layer of an antenna device according to an embodiment of the present disclosure.

Referring to FIG. 12A, the antenna area 120 and power feeding area 130 formed in the display antenna panel 100 may be provided in a transition form. As the antenna area 120 and the power feeding area 130 are provided in the transition form, the antenna radiation efficiency may become efficient. That is, according to the shape of transition of the antenna area 120 and the power feeding area 130, a loss rate may be identified through '$Loss=1-|S_{11}|^2-|S_{21}|^2$'. A relative conductivity may be identified through the loss rate obtained by the shape of transition of the antenna area and power feeding area. Accordingly, a signal current of at least one or more antennas provided in the display antenna panel 100 may be efficiently implemented (See FIG. 13A through FIG. 19B).

Figure 12B:
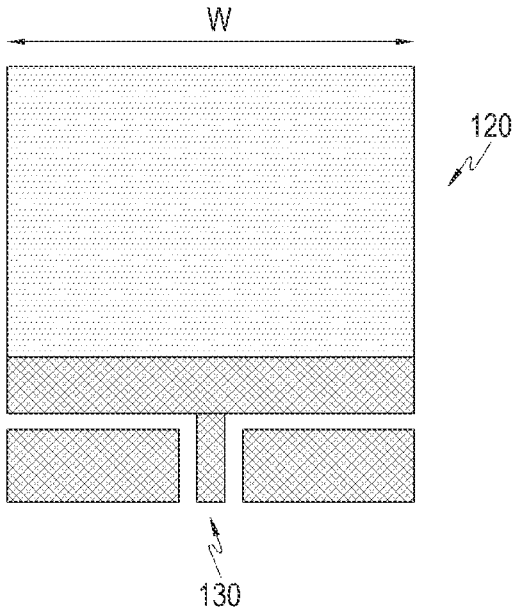

Further, referring to FIG. 12B, the display antenna panel 100 according to an embodiment of the present disclosure may be implemented as a hybrid type antenna depending on the type or shape of the antenna pattern 121 and power feeding pattern 131. Specifically, at least one or more antennas including the antenna area 120 and the power feeding area 130 may be implemented in the dielectric layer 110. Part of the power feeding area 130 and the antenna area 120 may be provided with a BM (black matrix), and the remainder of the antenna area may be provided with a plurality of conductive grids connected to the BM (black matrix). That is, depending on the transparent area VA or opaque area BA, part of the antenna area 120 may be provided with the BM (black matrix), and the remainder may be provided with the plurality of conductive grids, so that the BM (black matrix) and the plurality of conductive grids may co-exist. According to an embodiment of the present disclosure, the antenna radiation efficiency of the display antenna panel 100 may be determined depending on the width W of the antenna area 120 formed in the dielectric layer 100. The antenna radiation efficiency may be increased by allowing the conductive grids and BM (black matrix) to mismatchingly co-exist in at least one or more antennas formed in the display antenna panel 100 corresponding to the transparent area VA and the opaque area BA of the display device 100.

Figure 12C:
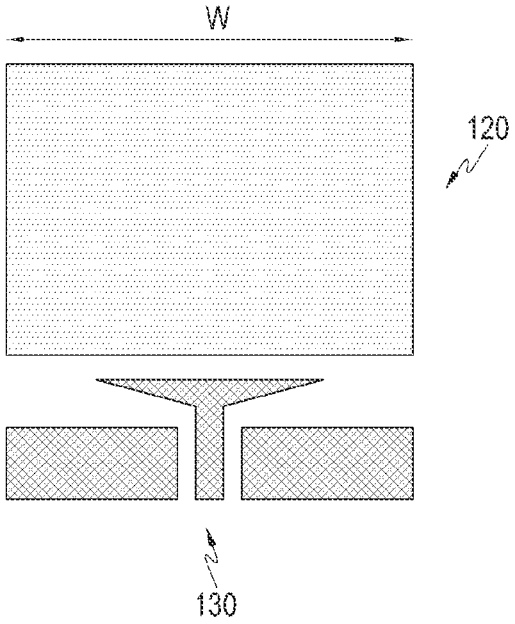

Further, referring to FIG. 12C, a coupled type antenna may be implemented depending on the connection state of the antenna area 120 and the power feeding area 130 implemented in the display antenna panel 100. Specifically, at least one or more antennas including the antenna area 120 and the power feeding area 130 may be implemented in the dielectric layer 110. The power feeding area 130 may be provided in a structure where the power feeding area 130 and the antenna area 120 are subjected to coupling power feeding. That is, according to an embodiment of the present disclosure, the antenna provided in the display antenna panel 100 may be implemented as a coupled type antenna in the position of the opaque area BA and the transparent area VA. Further, the antenna radiation efficiency may be determined depending on the width direction W of the antenna area 120. Accordingly, the antenna radiation efficiency may be determined depending on the width W of the antenna area 120, and the antenna radiation efficiency may be increased by the coupled power feeding structure.

Figure 12D:
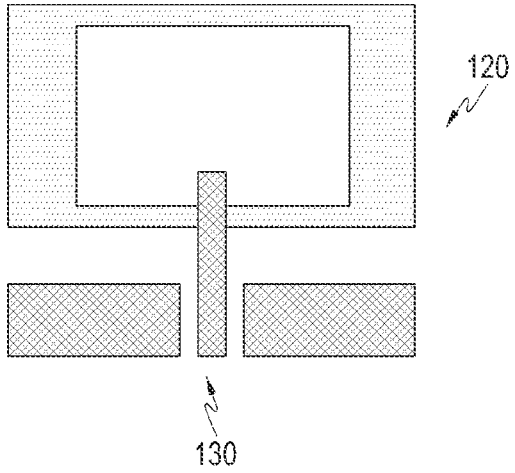

Further, referring to FIG. 12D, an aperture type antenna may be implemented depending on the shape of the antenna area 120 and the power feeding area 130 implemented in the display antenna panel 100. Specifically, as an antenna structure is implemented in which resonance occurs in the slot, the antenna radiation efficiency may be increased.

Figure 12E:
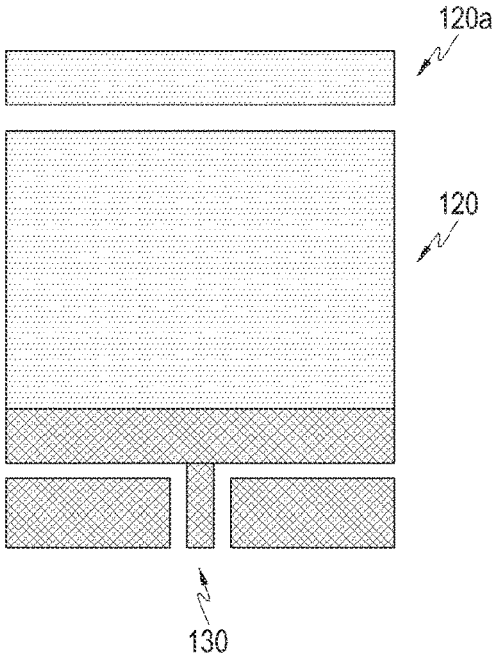

Further, referring to FIG. 12E, a parasitic type antenna may be implemented depending on the shape of the antenna area 120 and the power feeding area 130 implemented in the display antenna panel 100. Specifically, at least one or more antennas including the antenna area 120 and the power feeding area 130 may be implemented in the dielectric layer, and a parasitic patch area (120*a*) may be further provided in the antenna area 120. As such, as the antenna area 120 further includes the parasitic patch area (120*a*), the bandwidth may be increased.

Figure 12F:
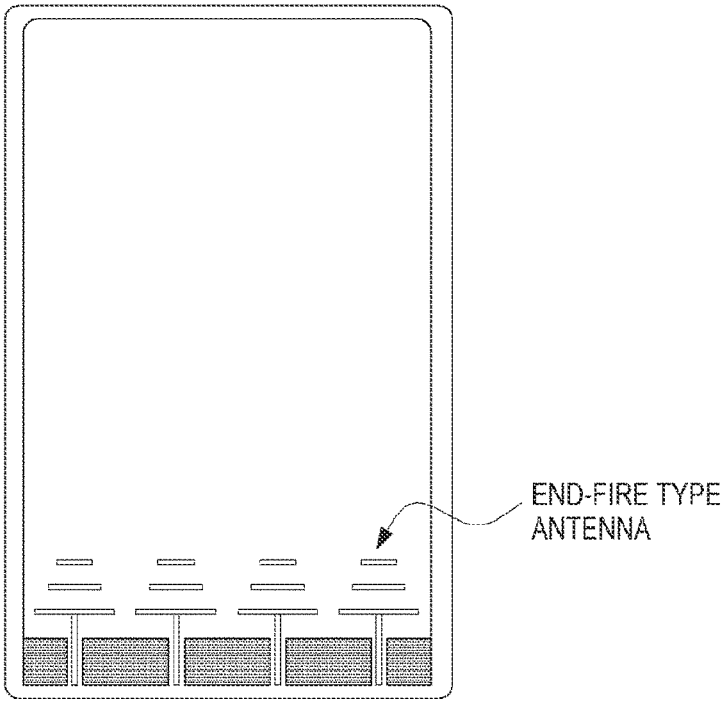

Further, referring to FIG. 12F, an end-fire type antenna may be implemented depending on the shape of the antenna area and the power feeding area implemented in the display antenna panel. Specifically, an end-fire beam steering may be provided corresponding to the position of the transparent area VA and opaque area BA of the dielectric layer 110. Accordingly, as shown in FIG. 12F, as the antenna area and the power feeding area are implemented in shape as the end-fire type antenna, a next-generation antenna technology such as mmWave may be secured.

Hereinafter, various embodiments of a coupling between a power feeding area and an antenna area are described with reference to FIGS. 13 to 18B.

First, referring to FIGS. 13A to 18B, at least one or more antenna areas 120 may be arranged on a surface of the dielectric layer 110. The antenna area 120 may include the transparent area VA of the display device 10 or the transparent area VA and an opaque area BA. The antenna area 120 may have an antenna pattern 121 with a plurality of conductive grids to transmit or receive electromagnetic waves.

The antenna pattern 121 may form a patch structure of radiation patterns depending on the shape of the plurality of conductive grids, and a radiation pattern may be formed having at least one of a slot structure, a loop structure, a monopole structure, and/or a dipole structure.

The power feeding area 130 may be positioned adjacent to the antenna area 120 and may be provided in the transparent area VA and/or opaque area BA of the display device 10. The power feeding area 130 may have a plurality of conductive grids and may provide a signal current to the antenna pattern 121. According to an embodiment of the present disclosure, the power feeding area 130 may be provided by a direct power feeding scheme in which the power feeding area 130 is directly connected to the antenna pattern 121 provided in the antenna area 120 to provide a signal current to the antenna pattern 121 (refer to FIG. 13A). Or, the power feeding area 130 may be provided by an indirect power feeding scheme in which, although the power feeding area 130 is not directly connected with the antenna pattern 121, the power feeding area 130 provides a signal current to the antenna pattern 121 through electric coupling or magnetic coupling (refer to FIGS. 16A and 16B). Further, the power feeding pattern 131 may be provided on the same surface of the dielectric layer 110 having the antenna pattern 121 and/or on a different surface from the antenna pattern 121 depending on various mounting environments such as the connection position, status of the feeding portion 101, structure of the dielectric layer 110, or the stacking state of the display device 10.

Figure 13A:
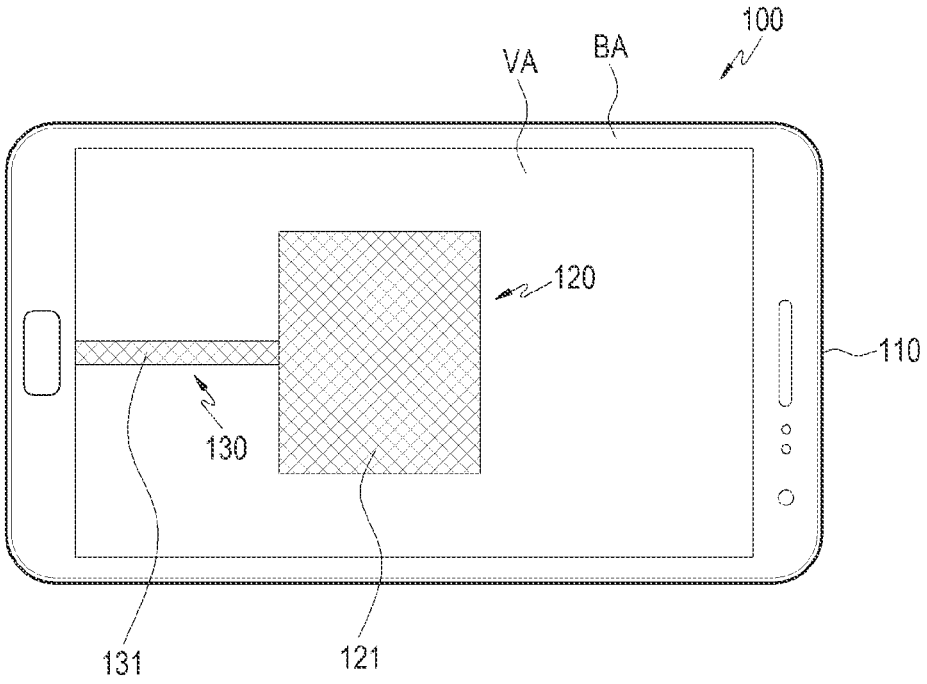
FIG. 13A is a view schematically illustrating an antenna device having an antenna area and a power feeding area directly coupled with each other co-planarly according to an embodiment of the present disclosure.
Figure 13B:
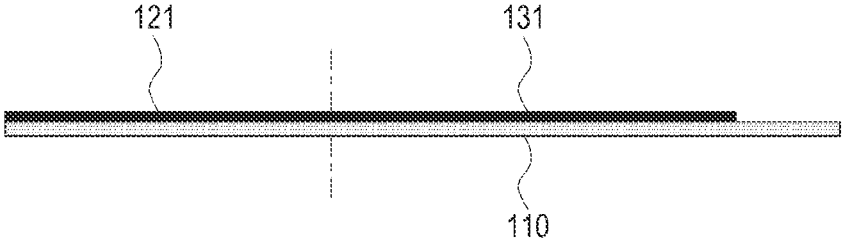
FIG. 13B is a cross-sectional view schematically illustrating an antenna device having an antenna area and a power feeding area directly coupled with each other co-planarly according to an embodiment of the present disclosure.
Figure 14A:
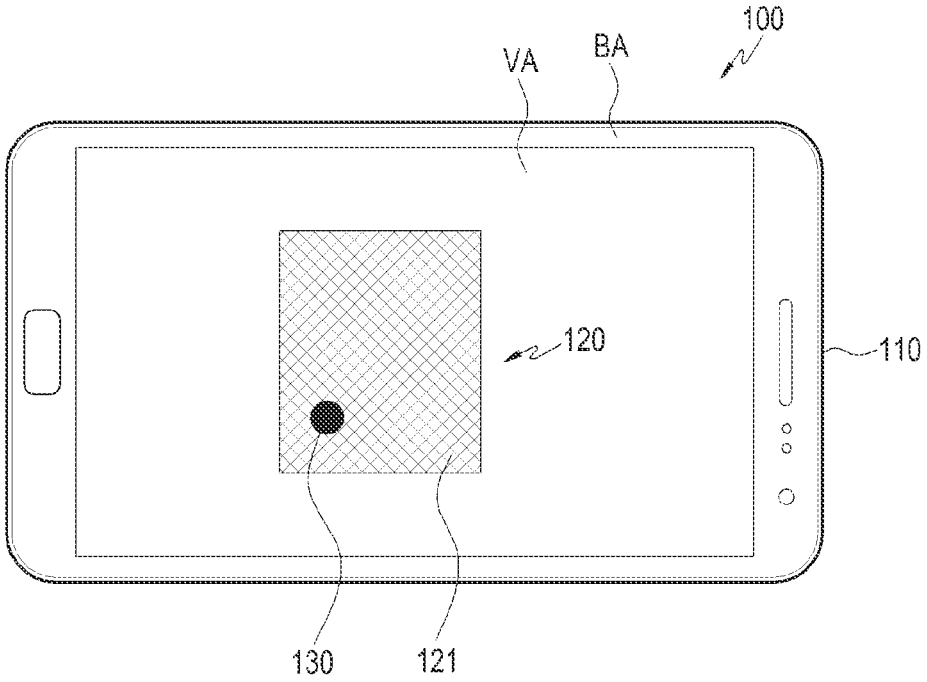
FIG. 14A is a view schematically illustrating an antenna device having an antenna area and a power feeding area directly coupled with each other on different planes according to an embodiment of the present disclosure.
Figure 14B:
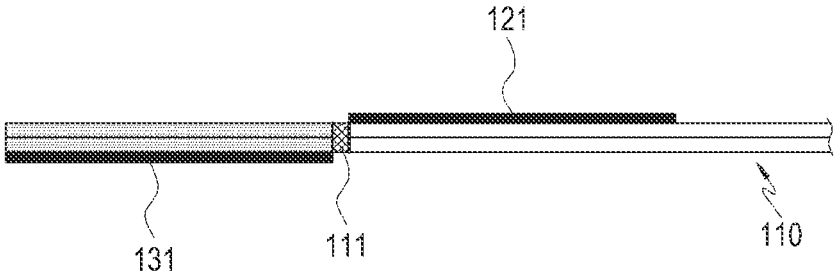
FIG. 14B is a cross-sectional view schematically illustrating an antenna device having an antenna area and a power feeding area directly coupled with each other on different planes according to an embodiment of the present disclosure.

FIG. 13A is a view schematically illustrating an antenna device having an antenna area and a power feeding area directly coupled with each other co-planarly according to an embodiment of the present disclosure. FIG. 13B is a cross-sectional view schematically illustrating an antenna device having an antenna area and a power feeding area directly coupled with each other co-planarly according to an embodiment of the present disclosure. FIG. 14A is a view schematically illustrating an antenna device having an antenna area and a power feeding area directly coupled with each other on different planes according to an embodiment of the present disclosure. FIG. 14B is a cross-sectional view schematically illustrating an antenna device having an antenna area and a power feeding area directly coupled with each other on different planes according to an embodiment of the present disclosure.

Referring to FIGS. 13A to 14B, the power feeding pattern 131 may be provided as a direct feeding portion that is coupled with the antenna pattern 121 to provide a signal current to the antenna pattern 121. That is, the power feeding pattern 131 may be directly coupled with the antenna pattern 121 to transfer a signal current through the feeding portion 101 to the antenna pattern 121. As mentioned above, the direct feeding portion may be provided on the same surface as the antenna pattern 121 on one surface of the dielectric layer 110 (refer to FIGS. 13A and 13B) and/or on a different surface from the antenna pattern 121 or on the other surface of the dielectric layer 110 (refer to FIGS. 14A and 14B) depending on, e.g., the structure of the dielectric layer 110.

For example, when the dielectric layer 110 is provided as a single layer, the direct feeding portion and the antenna pattern 121 may be provided together on one surface of the dielectric layer 110. By contrast, the antenna pattern 121 may be provided on one surface of the dielectric layer 110 while the direct feeding portion may be provided on the other surface of the dielectric layer 110. The power feeding pattern 131 may be coupled with the antenna pattern 121 through a via hole passing through the dielectric layer 110 (although not shown, refer to FIGS. 14A and 14B).

Further, when the dielectric layer 110 has a plurality of layers, the antenna pattern 121 and the direct feeding portion may be provided together on a surface of the stacked dielectric layer 110 (although not shown, refer to FIGS. 13A and 13B). In contrast, the antenna pattern 121 may be provided on one surface of the stacked dielectric layer 110 while the direct feeding portion may be provided on the other surface of the dielectric layer 110. The direct feeding portion may be coupled with the antenna pattern 121 through the via hole 111 formed in the stacked dielectric layer 110 (FIG. 14B).

Figure 15A:
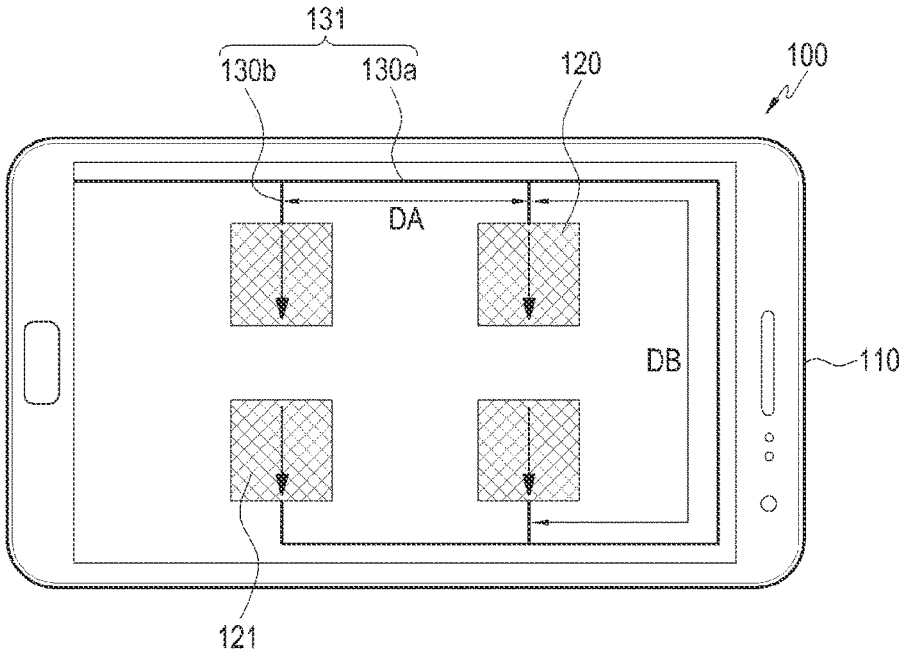
FIGS. 15A and 15B are views illustrating an antenna device having a plurality of antenna areas on a dielectric layer and a power feeding area according to an embodiment of the present disclosure.
Figure 15B:
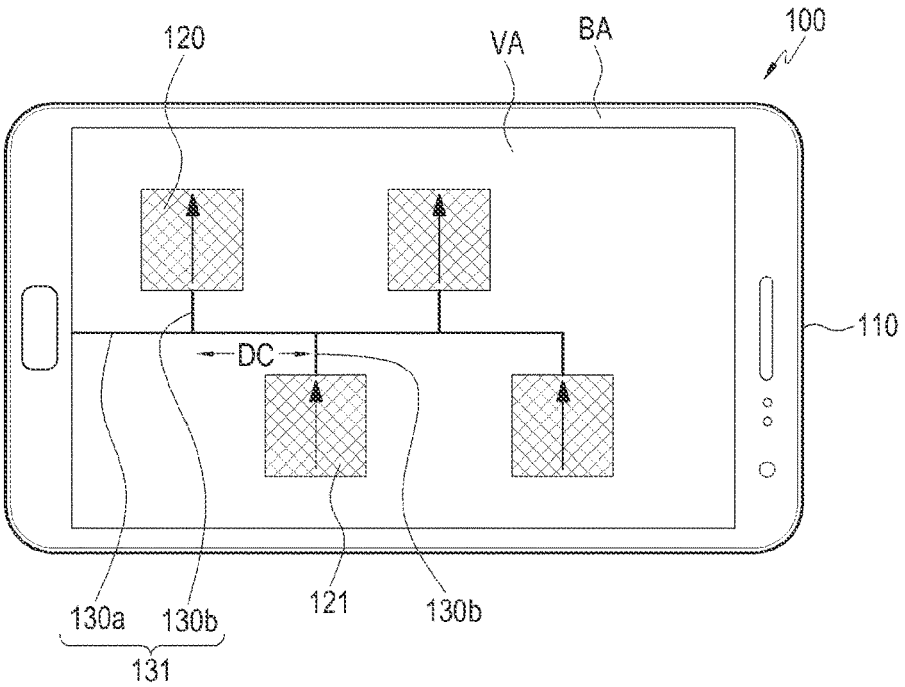

FIGS. 15A and 15B are views illustrating an antenna device having a plurality of antenna areas on a dielectric layer and a power feeding area according to an embodiment of the present disclosure.

Referring to FIGS. 15A and 15B, at least one or more antenna areas 120 may be provided on the dielectric layer 110. When a plurality of antenna areas 120 are provided on the dielectric layer 110, the direct feeding portion may provide a signal current to the antenna pattern 121 in a loop type (FIG. 15A) and/or in a parallel type (FIG. 15B). For example, when four antenna areas 120 are provided on one surface of the dielectric layer 110 according to an embodiment of the present disclosure, the power feeding pattern 131 may include a primary feeding line 130*a* and individual feeding lines 130*b*.

Specifically, referring to FIG. 15A, the loop-type direct feeding portion may have the primary feeding line 130*a* along the periphery of the dielectric layer 110 having the antenna area 120, specifically, along the periphery of the training area VA and/or opaque area BA, and the individual feeding lines 130*b* connected from the primary feeding line 130*a* to each antenna pattern 121. According to an embodiment of the present disclosure, when four antenna areas 120 are provided in a 2×2 array, the primary feeding line 130*a* is provided along the periphery of the transparent area VA. 'DA' and 'DB' which are distances between the individual feeding lines 130*b* are distances between the neighboring antenna areas 120 spaced apart from each other. The spaced distance, DA, may be 'λ', and the spaced distance, DB, may be '3λ/2'. Here, 'λ' means a resonant frequency of the radiation pattern.

By contrast, referring to FIG. 15B, the parallel-type direct feeding portion may have a primary feeding line 130*a* in the transparent area VA of the dielectric layer 110, having the antenna area 120 to pass through between the antenna area 120 and another antenna area 120 adjacent to the antenna area 120, and individual feeding lines 130*b* connected from the primary feeding line 130*a* to each antenna pattern 121. According to an embodiment of the present disclosure, when four antenna areas 120 are provided in a 2×2 array to cross each other, the primary feeding line 130*a* may be provided to pass through between antenna areas 120 at a side and antenna areas 120 at the other side. The spaced distance, DC, between the individual feeding lines 130*b* may be 'λ/2' from an antenna area 120 to another antenna area 120 adjacent to the antenna area 120. Here, 'λ' means a resonant frequency of the radiation pattern.

Figure 16A:
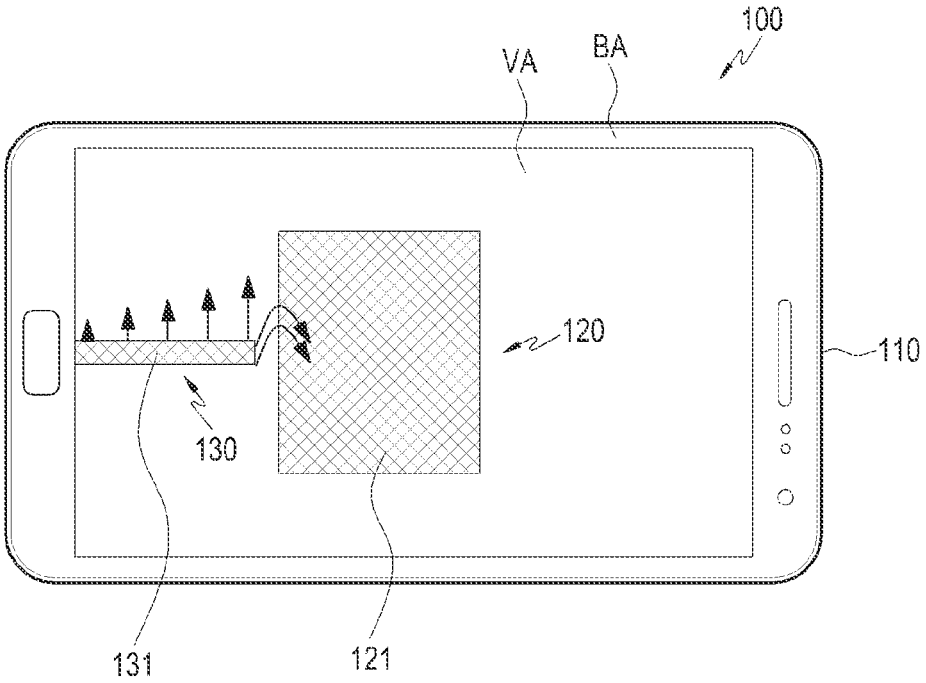
FIG. 16A is a view schematically illustrating an antenna device having an antenna area and a power feeding area disconnected from each other on the same plane and coupled with each other through an electric field, according to an embodiment of the present disclosure.
Figure 16B:
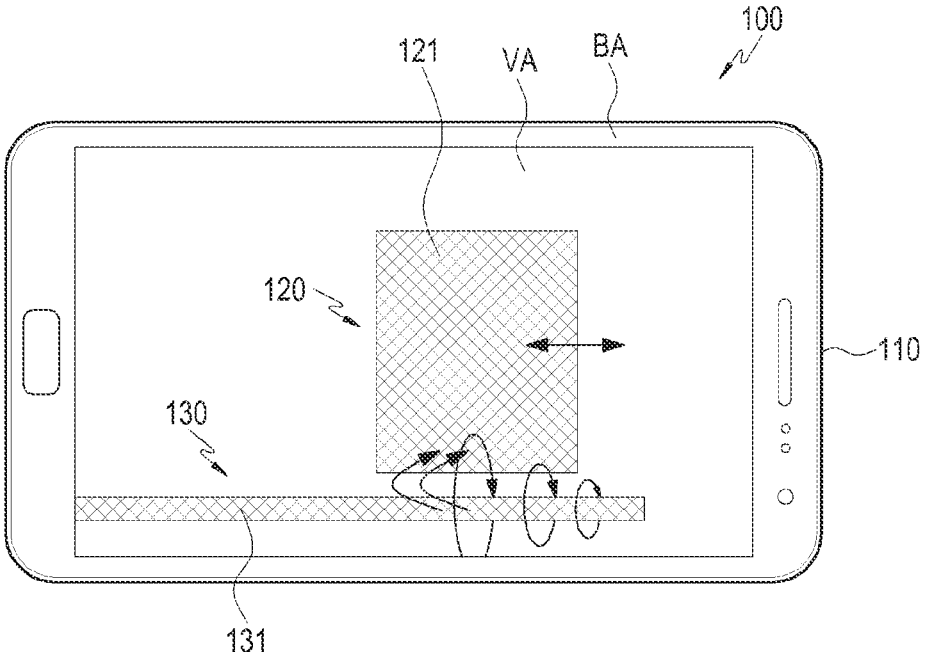
FIG. 16B is a view schematically illustrating an antenna device having an antenna area and a power feeding area disconnected from each other on the same plane and coupled with each other through a magnetic field, according to an embodiment of the present disclosure.
Figure 16C:
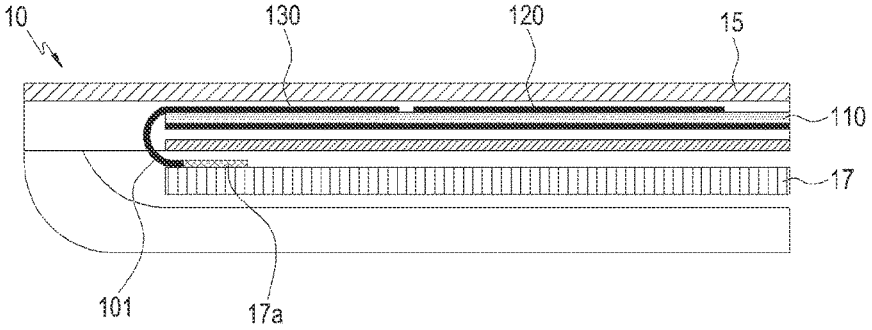
FIG. 16C is a cross-sectional view illustrating an antenna device having an indirect power feeding portion according to an embodiment of the present disclosure.

FIG. 16A is a view schematically illustrating an antenna device having an antenna area and a power feeding area disconnected from each other on the same plane and coupled with each other through an electric field, according to an embodiment of the present disclosure. FIG. 16B is a view schematically illustrating an antenna device having an antenna area and a power feeding area disconnected from each other on the same plane and coupled with each other through a magnetic field, according to an embodiment of the present disclosure. FIG. 16C is a cross-sectional view illustrating an antenna device having an indirect power feeding portion according to an embodiment of the present disclosure.

Referring to FIGS. 16A to 16C, unlike the direct feeding portion mentioned above, the power feeding pattern 131 may be provided as an indirect feeding portion that is provided adjacent to the antenna pattern 121 to provide a signal current to the antenna pattern 121 through magnetic coupling or electric coupling. Further, the indirect feeding portion may be provided on the same surface as the antenna pattern 121 on one surface of the dielectric layer 110 and/or on a different surface from the antenna pattern 121 on the other surface of the dielectric layer 110 depending on, e.g., the structure of the dielectric layer 110.

As mentioned above, the indirect feeding portion may come in a scheme using electric coupling (referring to an 'electric field type feeding pattern') and a scheme using magnetic coupling (referring to a 'magnetic field type feeding pattern').

When electric coupling is used as shown in FIG. 16A, a largest electric field may be generated at an end of the indirect feeding portion. Accordingly, the end of the indirect feeding portion may be provided adjacent to the antenna area 120. The indirect feeding portion, together with the antenna area 120, may be formed to have a 'T' shape. In contrast, as shown in FIG. 16B, when magnetic coupling is used, a largest electric field may occur at a side surface of the end of the indirect feeding portion. Accordingly, the power feeding pattern 131 may be provided such that the antenna area 120 may be positioned at the side surface of the end of the indirect feeding portion.

When the antenna area 120 and the power feeding area 130 are formed on the same plane in the dielectric layer 110 having a single layer or a plurality of stacked layers, the antenna area 120 may be positioned where a largest electric field or magnetic field is created in the indirect feeding portion as described above. Unlike this, as described below, when the antenna area 120 and the power feeding area 130 are positioned on different planes (refer to FIGS. 19A to 19C), an opening 113*a* (also denoted a 'via hole' in FIG. 19C) may be formed at a position where a larger electric field or magnetic field is created in the indirect feeding portion, and a signal may be transferred to the antenna area 120 through electric coupling or magnetic coupling by way of the via hole 113*a*.

Figure 17A:
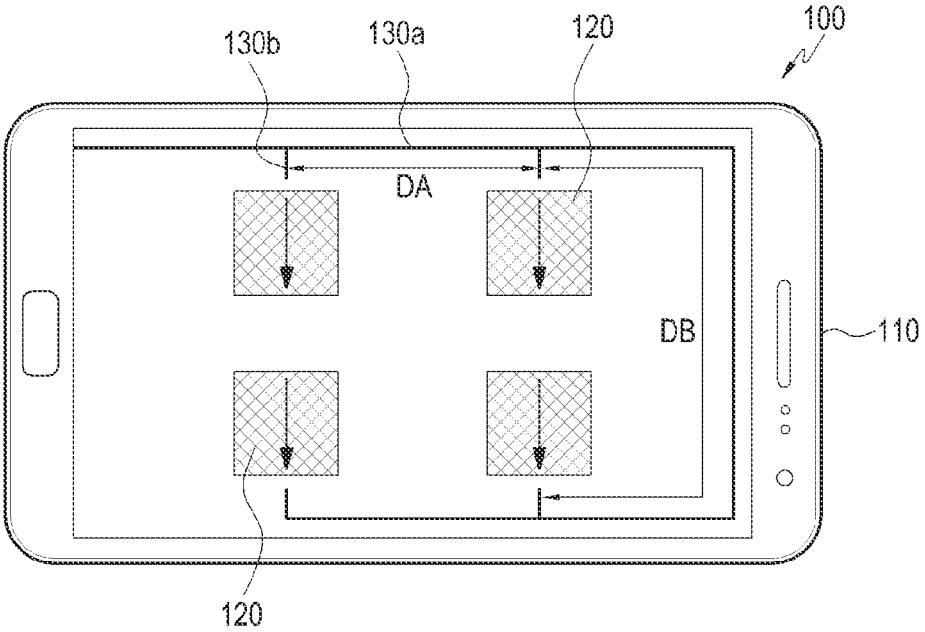
FIGS. 17A and 17B are views illustrating an antenna device having a plurality of antenna areas and an indirect power feeding portion coupled with the antenna areas through an electric field according to an embodiment of the present disclosure.
Figure 17B:
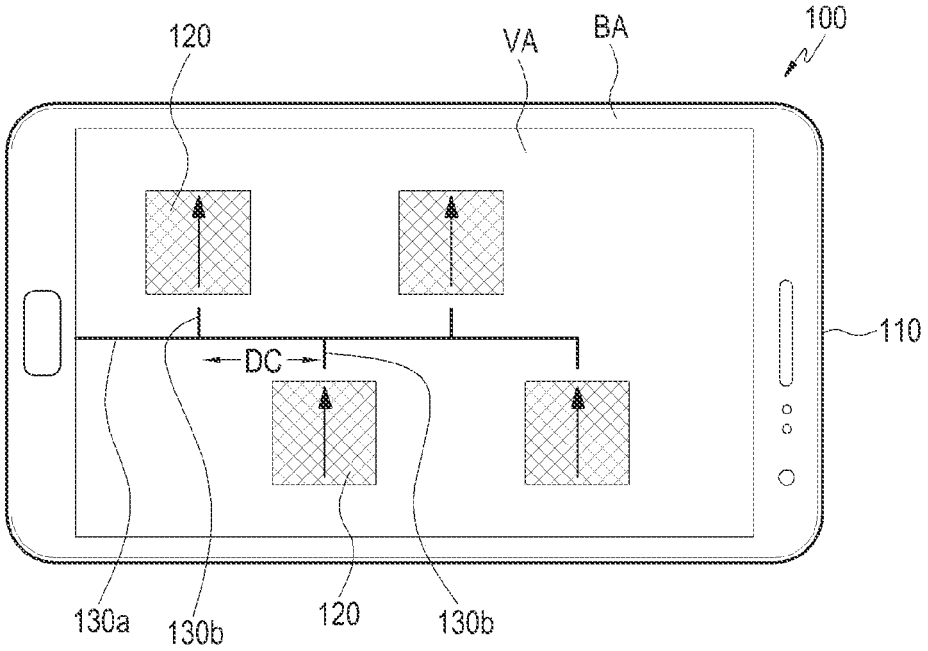

FIGS. 17A and 17B are views illustrating an antenna device having a plurality of antenna areas and an indirect power feeding portion coupled with the antenna areas through an electric field according to an embodiment of the present disclosure.

Referring to FIGS. 17A and 17B, at least one or more antenna areas 120 may be provided on the dielectric layer 110. When a plurality of antenna areas 120 are provided on the dielectric layer 110, the indirect feeding portion may provide a signal current to the antenna pattern 121 in a loop type and/or in a parallel type.

As mentioned above, the indirect feeding portion (hereinafter, referred to as a 'first indirect feeding portion') transferring a signal current to the antenna area 120 through electric coupling may be provided to have an individual feeding line 130*b* from the primary feeding line 130*a* to each antenna area 120 to transfer a signal as a largest electric field occurs at the end of the power feeding pattern 131.

Further, when a plurality of antenna areas 120 (specifically, four antenna areas 120) are provided on one surface of the dielectric layer 110 according to an embodiment of the present disclosure, the first indirect feeding portion may include a primary feeding line 130*a* and individual feeding lines 130*b*.

As shown in FIG. 17A, the loop-type first indirect feeding portion may have the primary feeding line 130*a* along the periphery of the dielectric layer 110 having the antenna area 120, specifically, along the periphery of the training area VA and/or opaque area BA, and the adjacent individual feeding line 130*b* from the primary feeding line 130*a* to each antenna pattern 121. According to an embodiment of the present disclosure, when four antenna areas 120 are provided in a 2×2 array, the primary feeding line 130*a* may be provided along the periphery of the transparent area VA, and individual feeding lines 130*b* may be provided adjacent to the antenna pattern 121 from the primary feeding line 130*a*.

Further, the spaced distance between the individual feeding lines 130*b* may be 'λ' or '3λ/2' from an individual feeding line 130*b* to its adjacent individual feeding line 130*b*. Here, 'λ' means a resonant frequency of the radiation pattern.

By contrast, referring to FIG. 17B, the parallel-type first indirect feeding portion may have a primary feeding line 130*a*, in the transparent area VA of the dielectric layer 110 having the antenna area 120 to pass through between the antenna area 120 and another antenna area 120 adjacent to the antenna area 120, and individual feeding lines 130*b* adjacent to each antenna area 120 from the primary feeding line. According to an embodiment of the present disclosure, when four antenna areas 120 are provided in a 2×2 array to cross each other, the primary feeding line 130*a* may be provided to pass through between antenna areas 120 at a side and antenna areas 120 at the other side. The spaced distance between the individual feeding lines 130*b* may be 'λ/2' from an antenna area 120 to another antenna area 120 adjacent to the antenna area 120. Here, 'λ' means a resonant frequency of the radiation pattern.

Figure 18A:
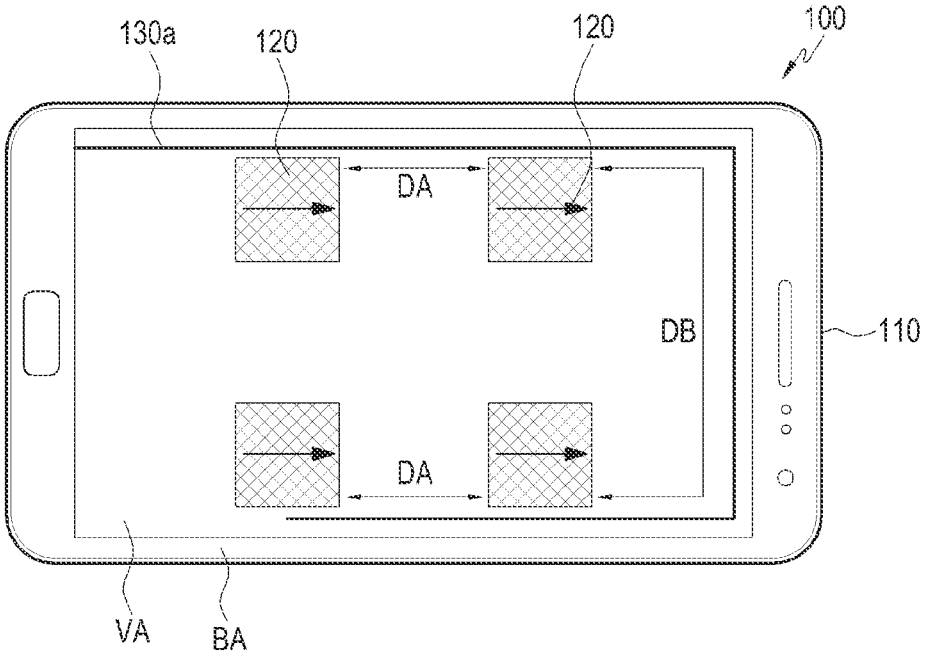
FIGS. 18A and 18B are views illustrating an antenna device having a plurality of antenna areas and an indirect power feeding portion coupled with the antenna areas through a magnetic field according to an embodiment of the present disclosure.
Figure 18B:
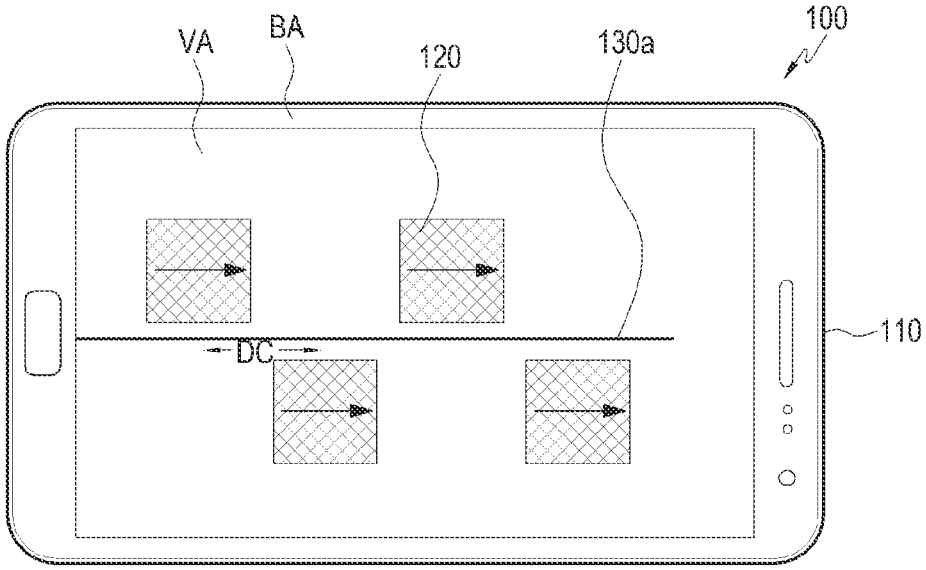

FIGS. 18A and 18B are views illustrating an antenna device having a plurality of antenna areas and an indirect power feeding portion coupled with the antenna areas through a magnetic field according to an embodiment of the present disclosure.

Referring to FIGS. 18A and 18B, there may be provided an indirect feeding portion (hereinafter, referred to as a 'second indirect feeding portion') transferring a signal current to the antenna area 120 through magnetic coupling unlike the electric coupling described above.

Magnetic coupling creates a largest electric field at a side surface of the end of the power feeding pattern 130*a*. Accordingly, the second indirect feeding portion provided by the primary feeding line 130*a* may be disposed neighboring the antenna area 120 to transfer a signal. In other words, the primary feeding line 130*a* may be provided in a loop type or parallel type adjacent to the antenna area 120 to transfer a signal current.

For example, when four antenna areas 120 are provided on one surface of the dielectric layer 110 according to an embodiment of the present disclosure, the second indirect feeding portion may include the primary feeding line 130*a*.

As shown in FIG. 18A, the loop-type second indirect feeding portion may have the primary feeding line 130*a* along the periphery of the dielectric layer 110 having the antenna area 120, specifically along the periphery of the transparent area VA and/or opaque area BA. According to an embodiment of the present disclosure, when four antenna areas 120 are provided in a 2×2 array, the primary feeding line 130*a* may be provided adjacent to a surface of each of the antenna areas 120 along the periphery of the transparent area VA. The spaced distance between the antenna areas 120 along the primary feeding line 130*a* may be 'λ' or '3λ/2.' Here, 'λ' means a resonant frequency of the radiation pattern.

By contrast, referring to FIG. 18B, the parallel-type second indirect feeding portion may have a primary feeding line 130*a* in the transparent area VA of the dielectric layer 110 having the antenna area 120 to pass through between the antenna area 120, and another antenna area 120 adjacent to the antenna area 120.

For example, according to an embodiment of the present disclosure, when four antenna areas 120 are provided in a 2×2 array to cross each other, the primary feeding line 130*a* may be provided to pass through between antenna areas 120 at a side and antenna areas 120 at the other side and to be positioned adjacent to a surface of each of the antenna areas 120. The spaced distance between the antenna areas 120 along the primary feeding line 130*a* may be 'λ/2.' Here, 'λ' means a resonant frequency of the radiation pattern.

Figure 19A:
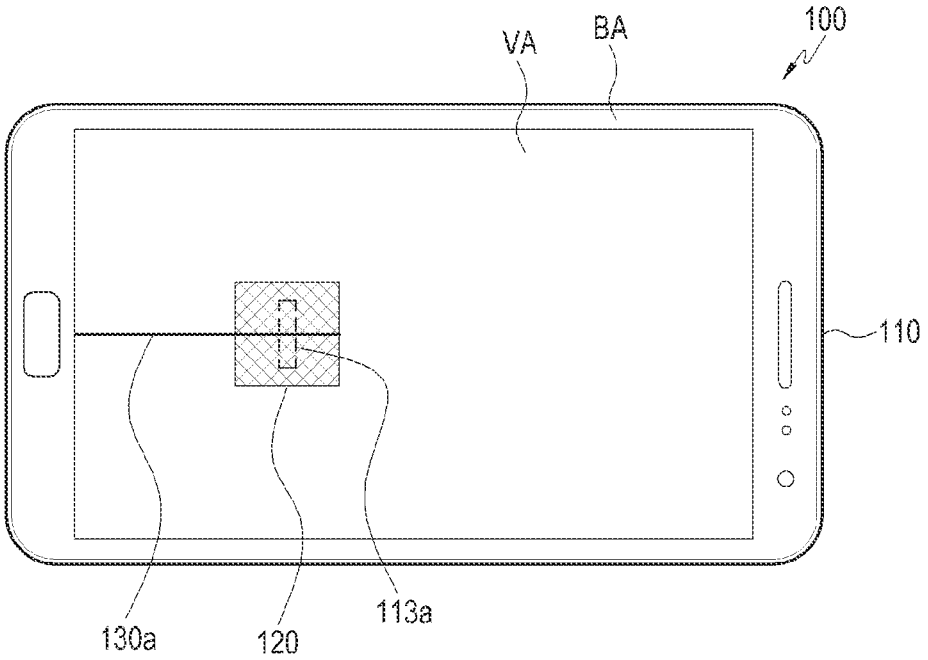
FIG. 19A is a view schematically illustrating an antenna device having an antenna area and a power feeding area as an indirect power feeding portion on different planes according to an embodiment of the present disclosure.
Figure 19B:
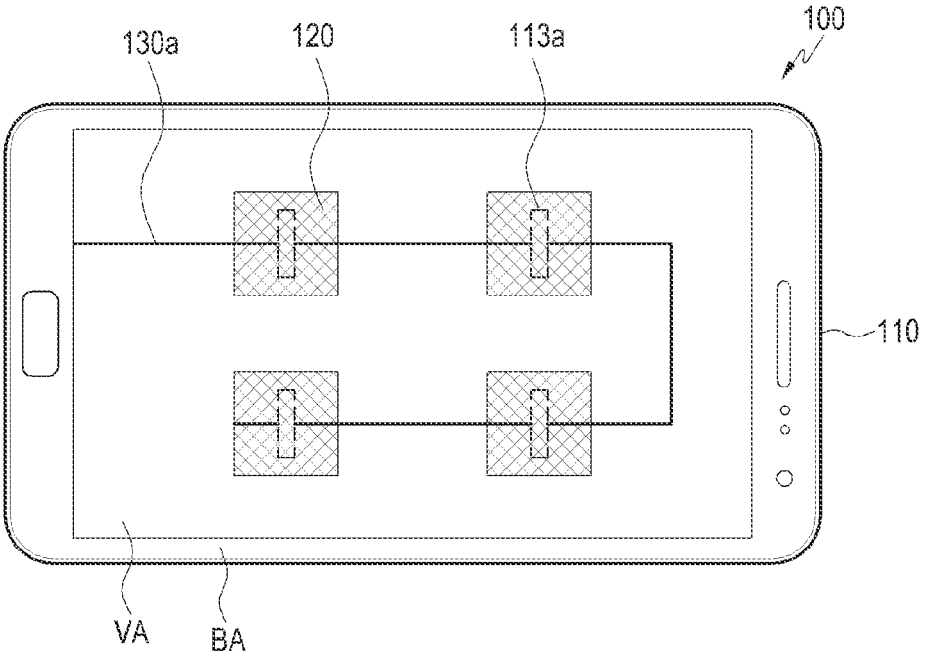
FIG. 19B is a view illustrating an antenna device having a plurality of antenna areas according to an embodiment of the present disclosure.
Figure 19C:
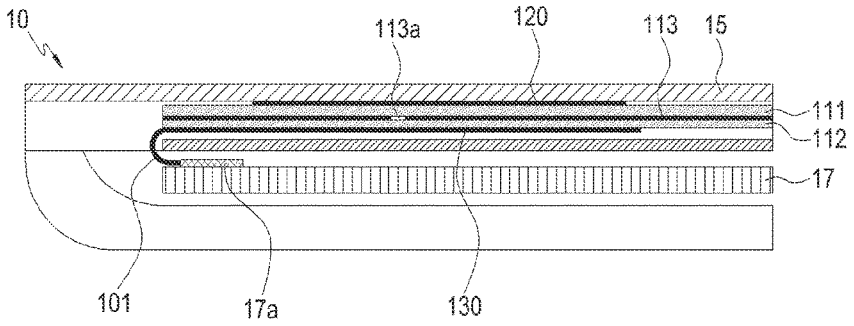
FIG. 19C is a cross-sectional view illustrating an antenna device having an indirect power feeding portion according to an embodiment of the present disclosure.

FIG. 19A is a view schematically illustrating an antenna device having an antenna area and a power feeding area as an indirect power feeding portion on different planes according to an embodiment of the present disclosure. FIG. 19B is a view illustrating an antenna device having a plurality of antenna areas according to an embodiment of the present disclosure. FIG. 19C is a cross-sectional view illustrating an antenna device having an indirect power feeding portion according to an embodiment of the present disclosure.

Referring to FIGS. 19A to 19C, when the power feeding area 130 is positioned on a surface different from the antenna area 120, the indirect feeding portion (including both electric coupling and magnetic coupling) may be provided to overlap the antenna area 120 at the same position. Further, an opening 113*a* (hereinafter, referred to as a 'via hole') may be formed in the dielectric layer 110 where a largest electric field or magnetic field is created in the indirect feeding portion. Accordingly, an electric field or magnetic field generated in the indirect feeding portion may allow a signal current to be transferred through the via hole 113*a* to the antenna area 120. The dielectric layer 110 may have one or more antenna areas 120.

Specifically, the dielectric layers 110 may include a first dielectric layer 111 having at least one or more antenna patterns 121 on a surface thereof and a second dielectric layer 112 formed on the first dielectric layer 111 and having an indirect feeding portion on a surface thereof. Further, a ground layer 113 may be provided between the first dielectric layer 111 and the second dielectric layer 112. The ground layer 113 may have at least one or more via holes 113*a* at a position where a relatively large electric field or magnetic field is generated in the power feeding pattern 131. Accordingly, the electric field or magnetic field signal current of the indirect feeding portion may be transferred through the via hole 113*a*.

For example, according to an embodiment of the present disclosure, when one antenna area 120 is provided in one surface of the first dielectric layer 111, the primary feeding line 130*a* may be formed straight to overlap the position of the antenna area 120. The via hole 113*a* may be formed at a side of the end of the primary feeding line 130*a* so that a signal current may be transferred to the antenna area 120 through the via hole 113*a*.

When a plurality of antenna areas 120 are provided in one surface of the first dielectric layer 111, specifically when four antenna areas 120 are formed, the primary feeding line 130*a* may be formed so that the indirect feeding portion overlaps the position of each antenna area 120. According to an embodiment of the present disclosure, when a 2×2 array of antenna areas 120 are provided, the primary feeding line 130*a* may be formed so that the indirect feeding portion is shaped as the letter "U." Further, at least four or more via holes 113*a* may be formed at the position where the primary feeding line 130*a* overlaps each antenna area 120. An electric field or magnetic field generated in the indirect feeding portion may allow a signal current to be transferred through the via hole 113*a* to the antenna area 120 provided at the position overlapping the same.

As described above, according to an embodiment of the present disclosure, as the display antenna panel 100 having a radiation efficiency is stacked on the display device 10, a plurality of antenna devices 100 may be provided in a limited space, and various shapes of the antenna area 120 and the power feeding area 130 may be provided in the transparent area VA and the opaque area BA of the display device 10. Further, a plurality of antenna areas 120 may be implemented depending on the shape of the power feeding pattern 131, increasing the data communication speed or efficiency of the electronic device. Further, the antenna device 100 may be provided on the overall surface of the electronic device, so that omni-directional radiation characteristics may be secured in a frequency bandwidth of a few tens of GHz.

While the inventive concept has been shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. An antenna device implemented in a display device, the antenna device comprising:

a dielectric layer provided in the display device;

an antenna area disposed in a surface of the dielectric layer, provided in a transparent area of the display device, and having at least one or more antenna patterns transmitting or receiving an electromagnetic wave through a plurality of conductive grids;

a power feeding area provided in at least one of the transparent area and an opaque area of the display device and having a power feeding pattern providing a signal current to the at least one or more antenna patterns through the plurality of conductive grids, wherein the power feeding pattern is a parallel type provided between the antenna pattern and a neighboring antenna pattern;

another plurality of conductive grids disposed at a periphery of the plurality of conductive grids to form a band stop area; and a transmission line portion connecting a substrate portion provided in the display device with the power feeding pattern, wherein the band stop area is configured to minimize a surface wave derived from the plurality of conductive grids.

2. The antenna device of claim 1, wherein the plurality of conductive grids provided in at least one of the power feeding area and the plurality of conductive grids provided in the antenna area are configured so that relatively more conductive grids are provided in a parallel direction with respect to a direction along which a signal current is applied, and relatively fewer conductive grids are provided in a series direction with respect to the direction along which the signal current is applied.

3. The antenna device of claim 1, wherein the power feeding pattern is provided as a direct feeding portion coupled with the antenna pattern to provide a signal current to the antenna pattern or as an indirect feeding portion separated from the antenna pattern to provide a signal current to the antenna pattern.

4. The antenna device of claim 3, wherein the power feeding pattern is provided as the direct feeding portion, and wherein the power feeding pattern is provided in one surface of the dielectric layer, which is a surface where the antenna pattern is mounted, or in another surface of the dielectric layer, which is a surface different from the surface where the antenna pattern is mounted and is connected to the antenna pattern through a via hole.

5. The antenna device of claim 4, wherein the power feeding pattern includes a primary feeding line passing through the antenna pattern and the neighboring antenna pattern and an individual feeding line connected from the primary feeding line to the antenna pattern.

6. The antenna device of claim 3, wherein the power feeding pattern is provided as the indirect feeding portion, and wherein the power feeding pattern is provided as at least one of an electric coupling type power feeding pattern in which an end creating a relatively large electric field in the power feeding pattern is provided adjacent to the antenna pattern and a magnetic coupling type power feeding pattern in which a periphery portion of the power feeding pattern creating a relatively large magnetic field is provided adjacent to the antenna pattern.

7. The antenna device of claim 6, wherein the electric coupling type power feeding pattern includes a primary feeding line provided between the antenna pattern and the neighboring antenna pattern and an individual feeding line provided adjacent to the antenna pattern from the primary feeding line.

8. The antenna device of claim 6, wherein a plurality of antenna patterns are mounted, and wherein the magnetic coupling type power feeding pattern is provided in a parallel type provided between the antenna pattern and the neighboring antenna pattern to provide a signal current to the antenna pattern adjacent to a periphery of the magnetic coupling type power feeding pattern.

9. The antenna device of claim 6, wherein the dielectric layer includes a first dielectric layer having the antenna pattern on a surface thereof and a second dielectric layer stacked on the first dielectric layer and having the power feeding pattern on a surface thereof, and wherein at least one or more openings are provided at a position where a relatively large electric field or magnetic field of the power feeding pattern occurs between the first dielectric layer and the second dielectric layer, and wherein an electric field or magnetic field signal current of the power feeding pattern is provided to the antenna pattern through the openings.

10. The antenna device of claim 1, wherein an artificial magnetic conductor (AMC) is provided in a plurality of uniform cells on a surface of the dielectric layer on which the antenna area is not disposed.

11. The antenna device of claim 1, wherein a stop band area is provided having a plurality of conductive grids formed in uniform cells at a periphery of the antenna pattern.

12. The antenna device of claim 1, wherein the antenna pattern is provided as a planar, omni-directional antenna.

13. An antenna device implemented in a display device, the antenna device comprising:

a dielectric layer provided in the display device; and an antenna module disposed on the dielectric layer and having a plurality of conductive grids transmitting or receiving an electromagnetic wave, wherein the plurality of conductive grids are configured so that relatively more conductive grids are provided in a parallel direction with respect to a direction along which a signal current is applied to the conductive grids, and relatively fewer conductive grids are provided in a series direction with respect to the direction along which the signal current is applied; and another plurality of conductive grids disposed at a periphery of the plurality of conductive grids and securing index matching in a transparent area of the display device with an index of an area formed the plurality of the conductive grids.

14. An antenna device implemented in a display device, the antenna device comprising:

a dielectric layer provided in the display device;

an antenna area disposed in a surface of the dielectric layer, provided in a transparent area of the display device, and having at least one or more antenna patterns transmitting or receiving an electromagnetic wave through a plurality of conductive grids;

a power feeding area provided in at least one of the transparent area and an opaque area of the display device and having a power feeding pattern providing a signal current to the at least one or more antenna patterns through the plurality of conductive grids, wherein the power feeding pattern is a loop type provided along a periphery of the transparent area where the power feeding pattern is an indirect feeding portion separated from the antenna pattern to provide a signal current to the antenna pattern;

another plurality of conductive grids disposed at a periphery of the plurality of conductive grids to form a band stop area; and a transmission line portion connecting a substrate portion provided in the display device with the power feeding pattern;

wherein the band stop area is configured to minimize a surface wave derived from the plurality of conductive grids.

* * * * *